US012279648B2

(12) United States Patent
Short

(10) Patent No.: US 12,279,648 B2
(45) Date of Patent: Apr. 22, 2025

(54) AEROSOL DELIVERY DEVICE WITH IMPROVED SEALING ARRANGEMENT

(71) Applicant: RAI Strategic Holdings, Inc., Winston-Salem, NC (US)

(72) Inventor: Jason M. Short, Winston-Salem, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 790 days.

(21) Appl. No.: 17/556,505

(22) Filed: Dec. 20, 2021

(65) Prior Publication Data

US 2023/0189881 A1 Jun. 22, 2023

(51) Int. Cl.
*A24F 40/42* (2020.01)
*A24F 40/46* (2020.01)

(52) U.S. Cl.
CPC ..... *A24F 40/42* (2020.01); *A24F 40/46* (2020.01)

(58) Field of Classification Search
CPC ..... A24F 40/42; A24F 40/46
See application file for complete search history.

(56) References Cited

U.S. PATENT DOCUMENTS 4,735,217 A 4/1988 Gerth et al.
4,793,365 A 12/1988 Sensabaugh, Jr. et al.
4,922,901 A 5/1990 Brooks et al.
4,947,874 A 8/1990 Brooks et al.
4,947,875 A 8/1990 Brooks et al.
5,060,671 A 10/1991 Counts et al.
5,101,839 A 4/1992 Jakob et al.
(Continued)

FOREIGN PATENT DOCUMENTS

WO WO 98/57556 12/1998
WO WO 2010/003480 1/2010
(Continued)

OTHER PUBLICATIONS

Chemical and Biological Studies on New Cigarette Prototypes that Heat Instead of Burn Tobacco, RJRTC Monograph, 1988.
(Continued)

*Primary Examiner* — James Harvey
(74) *Attorney, Agent, or Firm* — Womble Bond Dickinson (US) LLP

(57) ABSTRACT

The present invention includes an aerosol delivery device including a cartridge, an atomizer assembly arranged about a connecting end of the cartridge, and a control body operably engaged with the cartridge about the connecting end. The atomizer assembly includes a base defining a first surface engageable with the connecting end to define a reservoir chamber containing an aerosol precursor composition, an atomizer arranged about the first surface of the base, a liquid transport element defining opposing first and second ends with exposed end surfaces that are in fluid communication with the reservoir chamber, and a reservoir chamber sealing arrangement comprising a first sealing member to circumferentially seal the opposing first and second ends of the liquid transport element and expose the end surfaces thereof, such that the reservoir chamber is sealed by the reservoir chamber sealing arrangement except at the exposed end surfaces of the liquid transport element.

20 Claims, 7 Drawing Sheets

(56) References Cited

U.S. PATENT DOCUMENTS

| | | | |
|---|---|---|---|
| 5,154,192 | A | 10/1992 | Sprinkel et al. |
| 5,249,586 | A | 10/1993 | Morgan et al. |
| 5,261,424 | A | 11/1993 | Sprinkel, Jr. |
| 5,372,148 | A | 12/1994 | McCafferty et al. |
| 5,388,594 | A | 2/1995 | Counts et al. |
| 5,666,977 | A | 9/1997 | Higgins et al. |
| 5,934,289 | A | 8/1999 | Watkins et al. |
| 5,954,979 | A | 9/1999 | Counts et al. |
| 5,967,148 | A | 10/1999 | Harris et al. |
| 6,040,560 | A | 3/2000 | Fleischhauer et al. |
| 6,053,176 | A | 4/2000 | Adams et al. |
| 6,164,287 | A | 12/2000 | White |
| 6,196,218 | B1 | 3/2001 | Voges |
| 6,772,756 | B2 | 8/2004 | Shayan |
| 6,803,545 | B2 | 10/2004 | Blake et al. |
| 6,810,883 | B2 | 11/2004 | Felter et al. |
| 6,854,461 | B2 | 2/2005 | Nichols et al. |
| 7,040,314 | B2 | 5/2006 | Nguyen et al. |
| 7,293,565 | B2 | 11/2007 | Griffin et al. |
| 7,513,253 | B2 | 4/2009 | Kobayashi et al. |
| 7,726,320 | B2 | 6/2010 | Robinson et al. |
| 7,832,410 | B2 | 11/2010 | Hon |
| 7,896,006 | B2 | 3/2011 | Hamano et al. |
| 8,156,944 | B2 | 4/2012 | Han |
| 8,205,622 | B2 | 6/2012 | Pan |
| 8,365,742 | B2 | 2/2013 | Hon |
| 8,375,957 | B2 | 2/2013 | Hon |
| 8,402,976 | B2 | 3/2013 | Fernando et al. |
| 8,689,804 | B2 | 4/2014 | Fernando et al. |
| 8,794,231 | B2 | 8/2014 | Thorens et al. |
| 8,851,083 | B2 | 10/2014 | Oglesby et al. |
| 8,910,639 | B2 | 12/2014 | Chang et al. |
| 8,915,254 | B2 | 12/2014 | Monsees et al. |
| 8,925,555 | B2 | 1/2015 | Monsees et al. |
| 9,078,473 | B2 | 7/2015 | Worm et al. |
| 9,107,453 | B2 | 8/2015 | Dube et al. |
| 9,210,738 | B2 | 12/2015 | Ward et al. |
| 9,220,302 | B2 | 12/2015 | DePiano et al. |
| 9,423,152 | B2 | 8/2016 | Ampolini et al. |
| 9,484,155 | B2 | 11/2016 | Peckerar et al. |
| 10,018,393 | B2 | 7/2018 | Kopko et al. |
| 10,206,429 | B2 | 2/2019 | Davis et al. |
| 10,285,444 | B2 * | 5/2019 | Clemens ..... A24F 40/44 |
| 10,820,630 | B2 | 11/2020 | Davis et al. |
| 2006/0196518 | A1 | 9/2006 | Hon |
| 2008/0149118 | A1 | 6/2008 | Oglesby et al. |
| 2009/0095311 | A1 | 4/2009 | Han |
| 2009/0126745 | A1 | 5/2009 | Hon |
| 2009/0188490 | A1 | 7/2009 | Han |
| 2009/0260641 | A1 | 10/2009 | Monsees et al. |
| 2009/0260642 | A1 | 10/2009 | Monsees et al. |
| 2009/0272379 | A1 | 11/2009 | Thorens et al. |
| 2010/0024834 | A1 | 2/2010 | Oglesby et al. |
| 2010/0163063 | A1 | 7/2010 | Fernando et al. |
| 2010/0307518 | A1 | 12/2010 | Wang |
| 2012/0152265 | A1 | 6/2012 | Dube et al. |
| 2013/0180553 | A1 | 7/2013 | Gaus et al. |
| 2013/0192623 | A1 | 8/2013 | Tucker et al. |
| 2013/0255702 | A1 | 10/2013 | Griffith, Jr. et al. |
| 2013/0298905 | A1 | 11/2013 | Levin et al. |
| 2014/0000638 | A1 | 1/2014 | Sebastian et al. |
| 2014/0096781 | A1 | 4/2014 | Sears et al. |
| 2014/0261495 | A1 | 9/2014 | Novak, III et al. |
| 2015/0216232 | A1 | 8/2015 | Bless et al. |
| 2015/0245658 | A1 | 9/2015 | Worm et al. |
| 2015/0245659 | A1 | 9/2015 | DePiano et al. |
| 2015/0335071 | A1 | 11/2015 | Brinkley et al. |
| 2015/0344456 | A1 | 12/2015 | Dull et al. |
| 2016/0050975 | A1 | 2/2016 | Worm et al. |
| 2016/0158782 | A1 | 6/2016 | Henry, Jr. et al. |
| 2016/0262454 | A1 | 9/2016 | Sears et al. |
| 2017/0112191 | A1 | 4/2017 | Sur et al. |
| 2017/0112196 | A1 | 4/2017 | Sur et al. |
| 2017/0181471 | A1 | 6/2017 | Phillips et al. |
| 2019/0200673 | A1 | 7/2019 | Bless et al. |
| 2019/0289909 | A1 | 9/2019 | Hejazi |
| 2020/0288787 | A1 | 9/2020 | Hejazi |
| 2020/0352256 | A1 | 11/2020 | Hejazi et al. |
| 2020/0367572 | A1 * | 11/2020 | Hejazi ..... A61M 15/0028 |
| 2023/0189881 | A1 * | 6/2023 | Short ..... A24F 40/42 131/329 |

FOREIGN PATENT DOCUMENTS

| | | |
|---|---|---|
| WO | WO 2010/091593 | 8/2010 |
| WO | WO 2013/089551 | 6/2013 |

OTHER PUBLICATIONS

Gutcho, "Tobacco Flavoring Substances and Methods," Noyes Data Corp, 1972.

Leffingwell, et al., Tobacco Flavoring for Smoking Products, R.J. Reynolds Tobacco Company, 1972.

* cited by examiner

FIG. 4
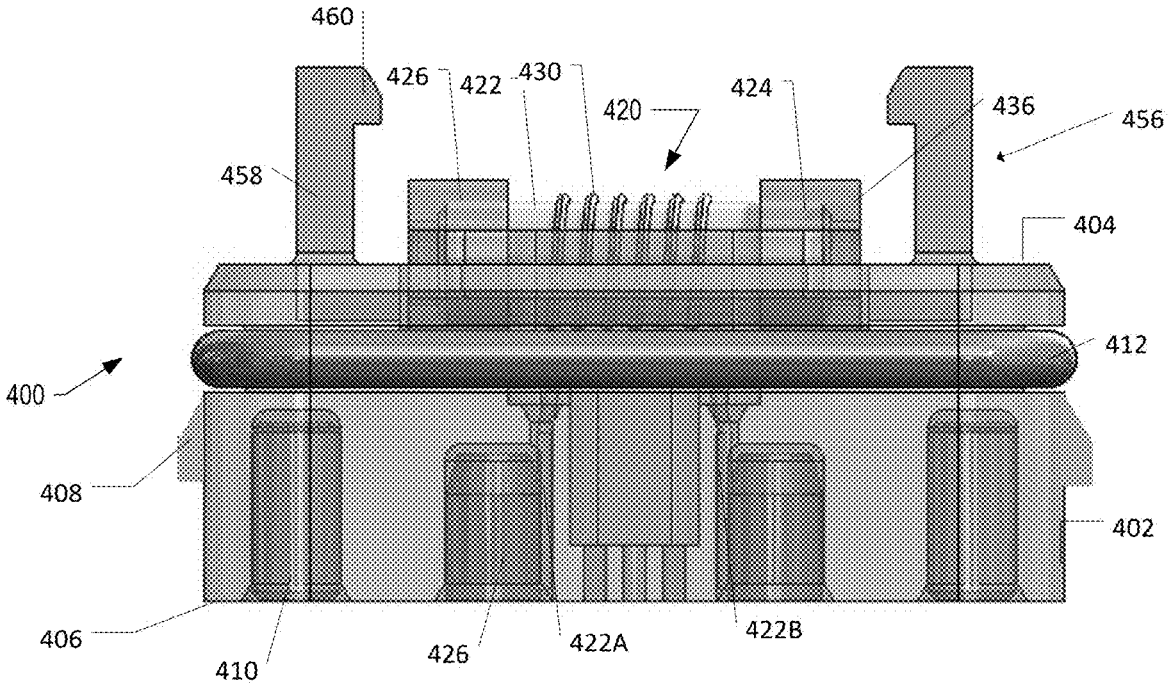
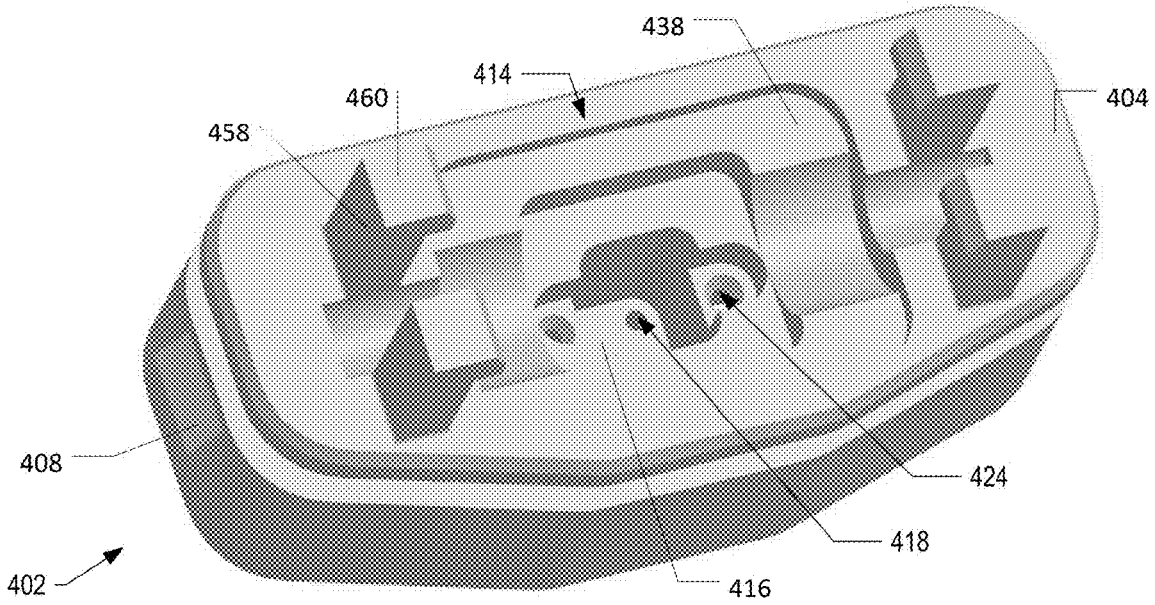
FIG. 5

AEROSOL DELIVERY DEVICE WITH IMPROVED SEALING ARRANGEMENT

FIELD OF THE DISCLOSURE

The present disclosure relates to aerosol delivery devices, and more particularly to aerosol delivery devices that include a sealing arrangement, which may utilize a sealing member to laterally and axially position an atomizer within a cartridge. The aerosol delivery devices of the present disclosure may utilize an aerosol precursor composition for the production of aerosol by the atomizer (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles may be made or derived from tobacco, or those articles may be characterized as otherwise incorporating tobacco for human consumption, and which may be capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0216232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides improved components.

SUMMARY OF THE DISCLOSURE

The present disclosure relates to aerosol delivery devices that may be used in formation of vapor. The present disclosure includes, without limitation, the following example implementations.

Example Implementation 1: An aerosol delivery device comprising: a cartridge comprising an outer housing formed of an outer wall, the outer housing having a mouth end and an opposing connecting end; an atomizer assembly arranged about the connecting end of the outer housing and comprising: a base defining a first surface and an opposing second surface, the first surface being engageable with the connecting end of the outer housing to define a reservoir chamber containing an aerosol precursor composition between the outer wall of the outer housing and the first surface of the base, an atomizer arranged about the first surface of the base to atomize the aerosol precursor composition and form an aerosol, a liquid transport element arranged about the first surface of the base and defining opposing first and second ends with exposed end surfaces that are in fluid communication with the reservoir chamber so as to direct the aerosol precursor composition from the reservoir chamber through the end surfaces of the liquid transport element and into contact with the atomizer, and a reservoir chamber sealing arrangement comprising a first sealing member arranged about the first surface of the base and receiving the opposing first and second ends of the liquid transport element to circumferentially seal the opposing first and second ends of the liquid transport element and expose the end surfaces thereof, such that the reservoir chamber is sealed by the reservoir chamber sealing arrangement except at the exposed end surfaces of the liquid transport element; and a control body operably engaged with the cartridge about the connecting end of the outer housing.

Example Implementation 2: The aerosol delivery device of Example Implementation 1, or any combination of preceding example implementations, wherein the reservoir chamber sealing arrangement comprises a flow director defining a base portion with a flow tube extending therefrom and arranged such that the first sealing member is disposed between the flow director and the first surface of the base, the flow tube being in fluid communication with the atomizer so as to direct the formed aerosol towards the mouth end of the outer housing.

Example Implementation 3: The aerosol delivery device of Example Implementations 1-2, or any combination of preceding example implementations, wherein the base further comprises a retaining member extending from the first surface thereof and engaging the flow director, the retaining member being arranged to compress the flow director against the first sealing member and the first surface of the base, and thereby seal the reservoir chamber except at the exposed end surfaces of the liquid transport element.

Example Implementation 4: The aerosol delivery device of Example Implementations 1-3, or any combination of preceding example implementations, wherein the retaining member comprises one or more pairs of arms extending substantially perpendicularly from the first surface of the base and one or more pairs of respective protrusions extending toward a center of the base, the protrusions engaging the base portion of the flow director to compress the base portion of the flow director against the first sealing member and the first surface of the base, and thereby seal the reservoir chamber except at the exposed end surfaces of the liquid transport element.

Example Implementation 5: The aerosol delivery device of Example Implementations 1-4, or any combination of preceding example implementations, wherein the first sealing member comprises a pair of opposing annular members comprising open receptacles, with a pair of opposite connecting flanges extending between the open receptacles, one of the first and second ends of the liquid transport element being at least partially received in one of the open receptacles such that the opposing first and second ends of the liquid transport element are circumferentially sealed by the open receptacles and the end surfaces are exposed, and the reservoir chamber is sealed by the reservoir chamber sealing arrangement at an interface between the base portion of the flow director and the flanges and receptacles of the liquid transport element except at the exposed end surfaces of the liquid transport element.

Example Implementation 6: The aerosol delivery device of Example Implementations 1-5, or any combination of preceding example implementations, wherein the cartridge further comprises a mouthpiece channel extending at least partially along a length of the reservoir chamber, the mouthpiece channel defining an open first and an open terminal end, the open first end being in fluid communication with the mouth end of the outer housing and the open terminal end being in fluid communication with the flow tube of the flow director such that the aerosol is directed through the mouthpiece channel.

Example Implementation 7: The aerosol delivery device of Example Implementations 1-6, or any combination of preceding example implementations, wherein the reservoir chamber sealing arrangement comprises a second sealing member arranged at the open terminal end of the mouthpiece channel to provide a seal between the flow tube and the mouthpiece channel.

Example Implementation 8: The aerosol delivery device of Example Implementations 1-7, or any combination of preceding example implementations, further comprising electrical contacts proximate the second surface of the base and providing electrical communication between the atomizer and a power source in the control body when the cartridge is engaged with the control body.

Example Implementation 9: The aerosol delivery device of Example Implementations 1-8, or any combination of preceding example implementations, wherein electrical terminals in electrical communication with the atomizer extend from the first surface of the base through the second surface of the base and contact the electrical contacts.

Example Implementation 10: The aerosol delivery device of Example Implementations 1-9, or any combination of preceding example implementations, wherein the atomizer comprises a coil having a plurality of turns and the liquid transport element defines an outer surface longitudinally extending between the end surfaces, the plurality of turns of the coil being wound about the outer surface and between the end surfaces of the liquid transport element.

Example Implementation 11: A cartridge for an aerosol delivery device, the cartridge comprising: an outer housing formed of an outer wall, the outer housing having a mouth end and an opposing connecting end; and an atomizer assembly arranged about the connecting end of the outer housing and comprising: a base defining a first surface and an opposing second surface, the first surface being engageable with the connecting end of the outer housing to define a reservoir chamber containing an aerosol precursor composition between the outer wall of the outer housing and the first surface of the base, an atomizer arranged about the first surface of the base to atomize the aerosol precursor composition and form an aerosol, a liquid transport element arranged about the first surface of the base and defining opposing first and second ends with exposed end surfaces that are in fluid communication with the reservoir chamber so as to direct the aerosol precursor composition from the reservoir chamber through the end surfaces of the liquid transport element and into contact with the atomizer, and a reservoir chamber sealing arrangement comprising a first sealing member arranged about the first surface of the base and receiving the opposing first and second ends of the liquid transport element to circumferentially seal the opposing first and second ends of the liquid transport element and expose the end surfaces thereof, such that the reservoir chamber is sealed by the reservoir chamber sealing arrangement except at the exposed end surfaces of the liquid transport element.

Example Implementation 12: The cartridge of Example Implementation 11, or any combination of preceding example implementations, wherein the reservoir chamber sealing arrangement comprises a flow director defining a base portion with a flow tube extending therefrom and arranged such that the first sealing member is disposed between the flow director and the first surface of the base, the flow tube being in fluid communication with the atomizer so as to direct the formed aerosol towards the mouth end of the outer housing.

Example Implementation 13: The cartridge of Example Implementations 11-12, or any combination of preceding example implementations, wherein the base further comprises a retaining member extending from the first surface thereof and engaging the flow director, the retaining member being arranged to compress the flow director against the first sealing member and the first surface of the base, and thereby seal the reservoir chamber except at the exposed end surfaces of the liquid transport element.

Example Implementation 14: The cartridge of Example Implementations 11-13, or any combination of preceding example implementations, wherein the retaining member comprises one or more pairs of arms extending substantially perpendicularly from the first surface of the base and one or more pairs of respective protrusions extending toward a center of the base, the protrusion engaging the base portion of the flow director to compress the base portion of the flow director against the first sealing member and the first surface of the base, and thereby seal the reservoir chamber except at the exposed end surfaces of the liquid transport element.

Example Implementation 15: The cartridge of Example Implementations 11-14, or any combination of preceding example implementations, wherein the first sealing member comprises a pair of opposing annular members comprising open receptacles, with a pair of opposite connecting flanges extending between the open receptacles, one of the first and second ends of the liquid transport element being at least partially received in one of the open receptacles such that the opposing first and second ends of the liquid transport element are circumferentially sealed by the open receptacles and the end surfaces are exposed, and the reservoir chamber is sealed by the reservoir chamber sealing arrangement at an interface between the base portion of the flow director and the flanges and receptacles of the liquid transport element except at the exposed end surfaces of the liquid transport element.

Example Implementation 16: The cartridge of Example Implementations 11-15, or any combination of preceding example implementations, wherein the cartridge further comprises a mouthpiece channel extending at least partially along a length of the reservoir chamber, the mouthpiece channel defining an open first and an open terminal end, the open first end being in fluid communication with the mouth end of the outer housing and the open terminal end being in fluid communication with the flow tube of the flow director such that the aerosol is directed through the mouthpiece channel.

Example Implementation 17: The cartridge of Example Implementations 11-16, or any combination of preceding example implementations, wherein the reservoir chamber sealing arrangement comprises a second sealing member arranged at the open terminal end of the mouthpiece channel to provide a seal between the flow tube and the mouthpiece channel.

Example Implementation 18: The cartridge of Example Implementations 11-17, or any combination of preceding example implementations, wherein the atomizer comprises a coil having a plurality of turns and the liquid transport element defines an outer surface longitudinally extending between the end surfaces, the plurality of turns of the coil being wound about the outer surface and between the end surfaces of the liquid transport element.

Example Implementation 19: A method of manufacturing a cartridge for an aerosol delivery device, the method comprising: providing an atomizer assembly comprising a base defining a first surface and an opposing second surface, an atomizer arranged about the first surface of the base to atomize the aerosol precursor composition and form an aerosol, a liquid transport element arranged about the first surface of the base, and a reservoir chamber sealing arrangement comprising a first sealing member arranged about the first surface of the base and receiving the opposing first and second ends of the liquid transport element to circumferentially seal the opposing first and second ends of the liquid transport element and expose the end surfaces thereof, arranging the atomizer assembly about a connecting end of an outer housing of a cartridge, the outer housing having a closed mouth end opposing the connecting end; and engaging the first surface of the base with the connecting end of the outer housing to define a reservoir chamber containing an aerosol precursor composition between the outer wall of the outer housing and the first surface of the base, such that the reservoir chamber is sealed by the reservoir chamber sealing arrangement except at the exposed end surfaces of the liquid transport element, wherein the exposed end surfaces of the liquid transport element are in fluid communication with the reservoir chamber so as to direct the aerosol precursor composition from the reservoir chamber through the end surfaces of the liquid transport element and into contact with the atomizer.

Example Implementation 20: The method of Example Implementation 19, or any combination of preceding example implementations, wherein providing the atomizer assembly comprises providing a flow director defining a base portion with a flow tube extending therefrom and arranged such that the first sealing member is disposed between the flow director and the first surface of the base, the flow tube being in fluid communication with the atomizer so as to direct the formed aerosol towards the mouth end of the outer housing.

It will be appreciated that the above Summary is provided merely for purposes of summarizing some example aspects so as to provide a basic understanding of some aspects of the disclosure. As such, it will be appreciated that the above described example aspects are merely examples of some aspects and should not be construed to narrow the scope or spirit of the disclosure in any way. It will be appreciated that the scope of the disclosure encompasses many potential aspects, some of which will be further described below, in addition to those here summarized. Further, other features, aspects, and advantages of the disclosure will be apparent from a reading of the following detailed description taken in conjunction with the accompanying drawings which illustrate, by way of example, the principles of the described aspects.

BRIEF DESCRIPTION OF THE FIGURES

In order to assist the understanding of aspects of the disclosure, reference will now be made to the appended drawings, which are not necessarily drawn to scale and in which like reference numerals refer to like elements. The drawings are exemplary only, and should not be construed as limiting the disclosure.

FIG. 4 illustrates a front view of an atomizer assembly for an aerosol delivery device with improved sealing arrangement according to some example implementations of the present disclosure;

FIG. 5 illustrates a top perspective view of a base for an atomizer assembly for an aerosol delivery device with improved sealing arrangement according to some example implementations of the present disclosure;

DETAILED DESCRIPTION

Figure 1:
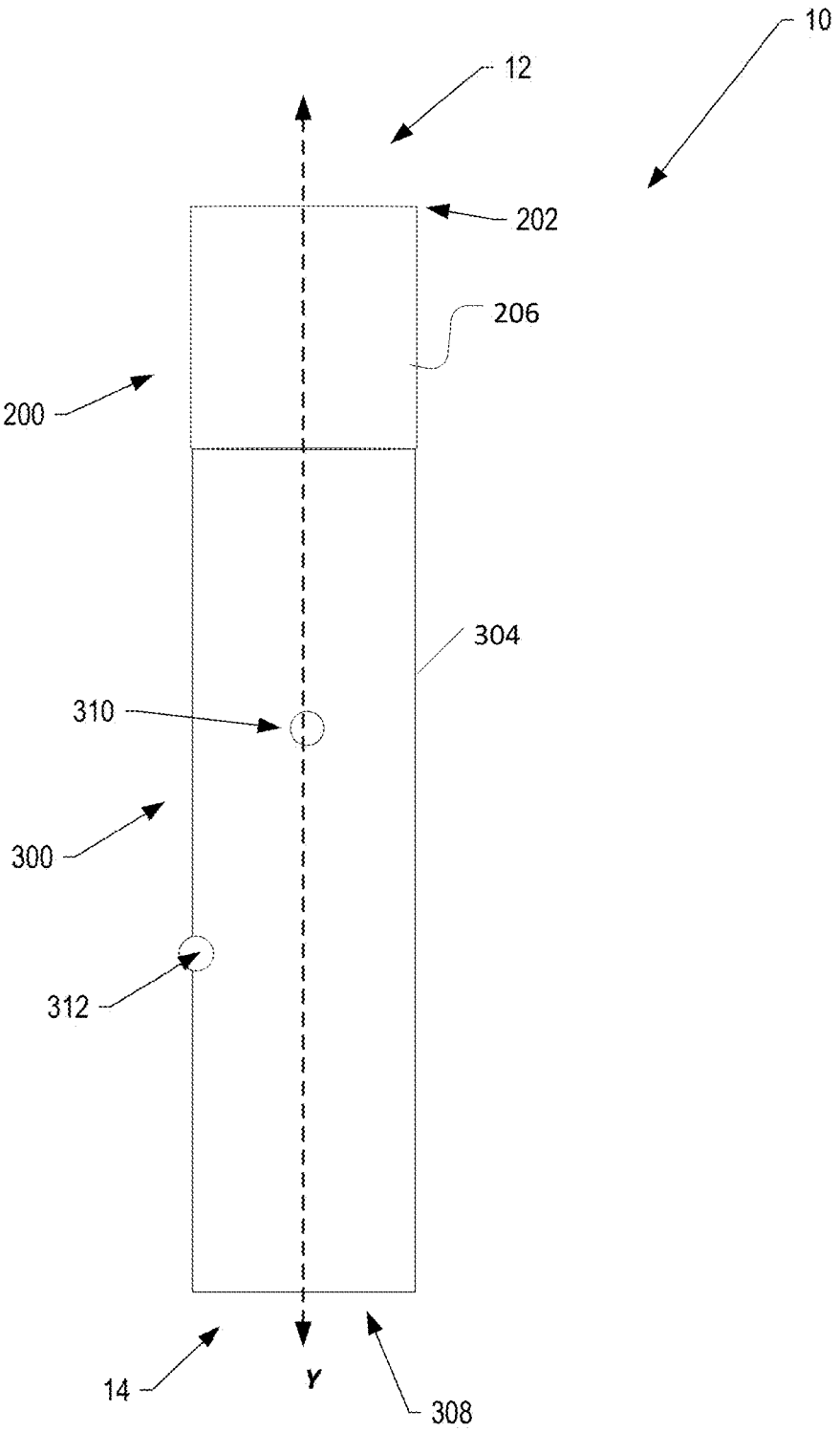
FIG. 1 illustrates a front view of an aerosol delivery device with improved sealing arrangement according to some example implementations of the present disclosure.

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles, such as aerosol delivery devices (and the assembly and/or manufacture thereof) in which an aerosol precursor composition is heated (preferably without combusting the material to any significant degree) to form an aerosol and/or an inhalable substance; such articles most preferably being sufficiently compact to be considered "hand-held" devices. In some aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or aerosol delivery device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In some aspects, articles or devices characterized as smoking articles incorporate tobacco and/or components derived from tobacco.

As noted, aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that device much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery devices, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "electronic cigarettes," it should be understood that the mechanisms, components, features, and methods may be embodied in many different forms and associated with a variety of articles. For example, the description provided herein may be employed in conjunction with implementations of tobacco heating products, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Aerosol delivery devices of the present disclosure generally include a number of components provided within an outer body or shell, which may be referred to as an outer housing. The overall design of the outer body or shell can vary, and the format or configuration of the outer body that can define the overall size and shape of the aerosol delivery device can vary. In some example implementations, an elongated body resembling the shape of a cigarette or cigar can be formed from a single, unitary housing or the elongated housing can be formed of two or more separable bodies—e.g., a cartridge and a control body. For example, an aerosol delivery device can comprise an elongated shell or body that can be substantially tubular in shape and, as such, resemble the shape of a conventional cigarette or cigar. In another example, an aerosol delivery device may be substantially rectangular, trapezoidal, or have a substantially rectangular cuboid shape. In one example, all of the components of the aerosol delivery device are contained within one housing. Alternatively, an aerosol delivery device can comprise two or more housings that are joined and are separable. For example, an aerosol delivery device can possess one portion comprising a housing containing one or more reusable components (e.g., an accumulator such as a rechargeable battery and/or rechargeable supercapacitor, and various electronics for controlling the operation of that article), and removably coupleable thereto, another second portion (e.g., a mouthpiece) and/or a disposable component (e.g., a disposable flavor-containing cartridge containing aerosol precursor material, flavorant, etc.). More specific formats, configurations and arrangements of components within the single housing type of unit or within a multi-piece separable housing type of unit will be evident in light of the further disclosure provided herein. Additionally, various aerosol delivery device designs and component arrangements can be appreciated upon consideration of the commercially available electronic aerosol delivery devices.

As will be discussed in more detail below, control bodies of aerosol delivery devices of the present disclosure may comprise some combination of a power source (e.g., an electrical power source), at least one control component (e.g., means for actuating, controlling, regulating and ceasing power, such as by controlling electrical current flow from the power source to other components of the article—e.g., a microprocessor, individually or as part of a microcontroller, a printed circuit board (PCB) that includes a microprocessor and/or microcontroller, etc.), and a receiving chamber. Such control bodies may be configured to accept one or more cartridges that include an aerosol precursor composition capable of yielding an aerosol upon application of sufficient heat from an atomizer. In some implementations, the cartridge may define a reservoir chamber to contain the aerosol precursor composition, the atomizer, and a mouthpiece configured to allow drawing upon for aerosol inhalation (e.g., a defined airflow path through the combined cartridge and control body such that aerosol generated can be withdrawn therefrom upon draw). More specific formats, configurations and arrangements of components within the aerosol delivery systems of the present disclosure will be evident in light of the further disclosure provided hereinafter. Additionally, the selection and arrangement of various aerosol delivery system components can be appreciated upon consideration of the commercially available electronic aerosol delivery devices, such as those representative products referenced in background art section of the present disclosure.

In various aspects, the aerosol precursor composition may be aerosolized to form an aerosol. The aerosol precursor composition may comprise tobacco products or a composite of tobacco with other materials. Other implementations may use non-tobacco products. Accordingly, the aerosol precursor composition can vary, and mixtures of various aerosol precursor compositions can be used.

According to certain aspects of the present disclosure, it may be advantageous to provide an aerosol delivery device that is easy to use and that provides improved components. One example aspect of an aerosol delivery device, generally designated 10, is provided in FIG. 1. As shown in FIG. 1, the aerosol delivery device 10 defines a longitudinal axis Y that extends from a first end 12 to an opposing second end 14 of the aerosol delivery device 10. The aerosol delivery device 10 may be substantially rod-like or substantially tubular, cylindrical, or oval-shaped in some aspects. Although the aerosol delivery device 10 is illustrated as being substantially tubular and oval in shape in FIG. 1, other suitable shapes and dimensions (e.g., a rectangular or triangular cross-section or the like) are also encompassed by the present disclosure.

Figure 2:
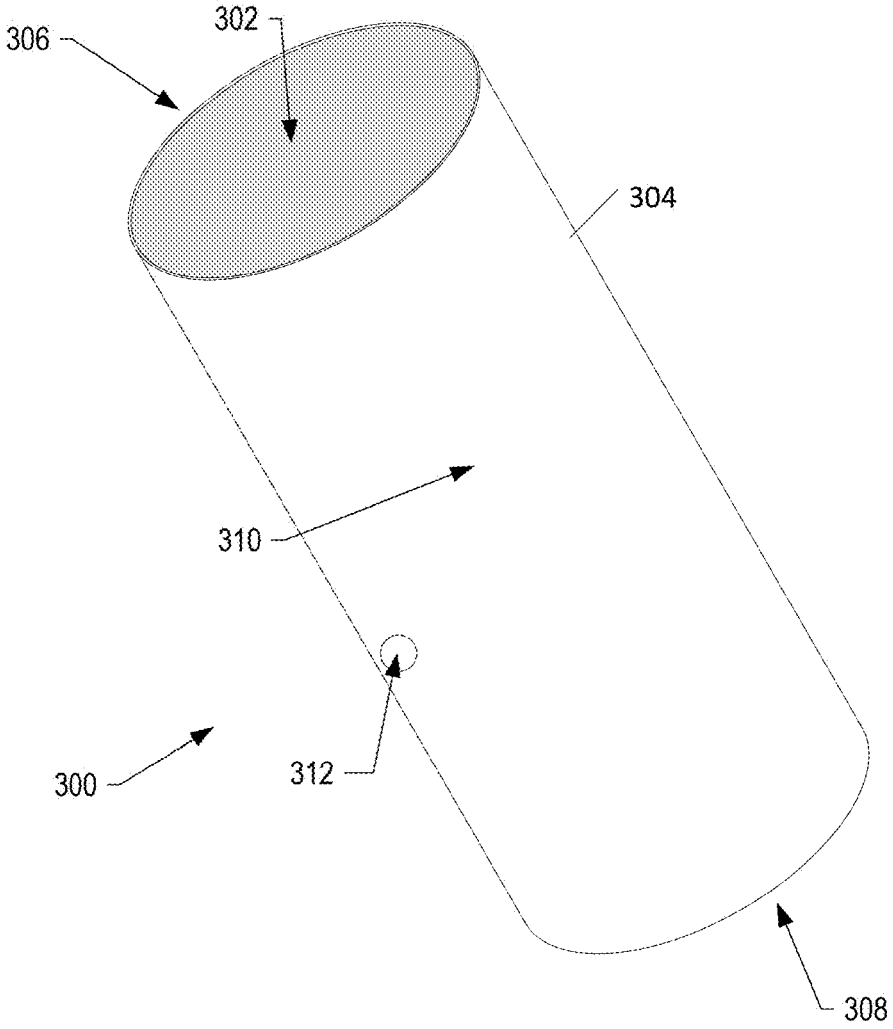
FIG. 2 illustrates a top perspective view of a control body of an aerosol delivery device with improved sealing arrangement according to some example implementations of the present disclosure.

The aerosol delivery device 10 can include a cartridge 200 and a control body 300, which may be operably engaged with one another either permanently or detachably in a functioning relationship. Operable engagement between the cartridge 200 and the control body 300 can be press fit, threaded, interference fit, magnetic, ultrasonic welded, snap fit, and/or the like. In some example implementations, the control body 300 defines a receiving chamber 302 (FIG. 2) within an outer shell or housing 304 into which the cartridge 200 is insertable and securable via operable engagement therewith.

For example, the outer shell or housing 304 of the control body 300 comprises an open connecting end 306 (see FIG. 2) and an opposing closed distal end 308. The open connecting end 306 may define an opening that leads to the receiving chamber 302. As described in more detail below, the control body 300 may include an indicator 310 configured to provide visual indication of one or more conditions of the device 100. In various example implementations, the cartridge 200 may be received by the control body 300 (and in particular, the receiving chamber 302) into a use position. As will be described in more detail below, in the use position, an atomizer may be powered to aerosolize an aerosol precursor composition contained within the cartridge 200 for delivery to a consumer.

Figure 3A:
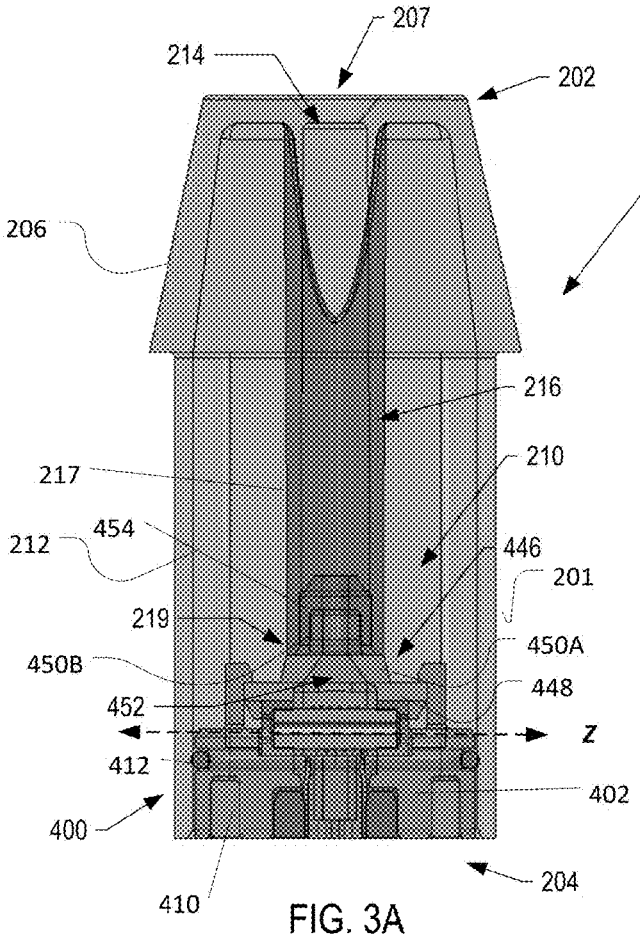
FIGS. 3A and 3B illustrate various views of a cartridge with an atomizer assembly for an aerosol delivery device with improved sealing arrangement according to some example implementations of the present disclosure.
Figure 3B:
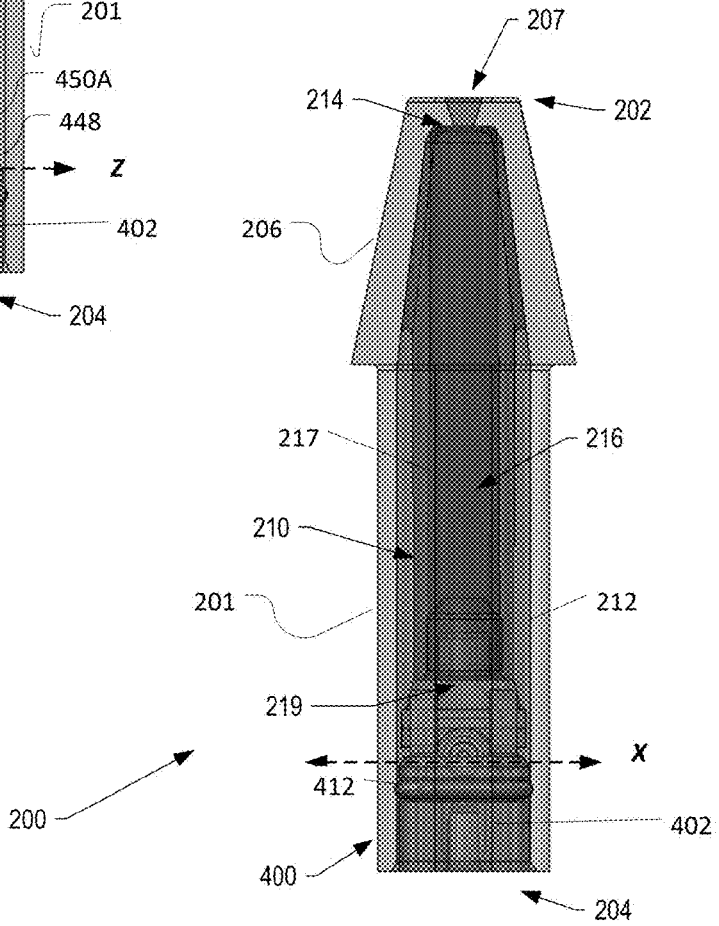

In some example implementations, and as shown in FIGS. 3A and 3B and shown in more detail in FIG. 4, the cartridge 200 comprises an atomizer assembly 400 that may be operably engaged with a power source (not shown) contained in the control body 300. In some example implementations, the control body 300 and the cartridge 200 may be operably engaged with one another in a functioning relationship such that the power source provides power to the atomizer assembly 400 and/or additional control functionality as described in greater detail herein. The atomizer assembly 400 may be disposed in the cartridge 200, or may be disposed within the control body 300 and may be configured to operably engage a reservoir chamber 210 of the cartridge 200. Further aspects of such devices are described in U.S. Pat. App. Pub. No. 2016/0050975 to Worm et al., filed Aug. 21, 2014, and U.S. Pat. App. Pub. No. 2017/0181471 to Phillips et al., filed Dec. 28, 2015, the disclosures of which are incorporated herein by reference.

According to some example implementations, one or any of the cartridge 200, the control body 300, and/or the atomizer assembly 400 may be referred to as being disposable in that the device 10 may be configured for only a limited number of uses (e.g., until the power source no longer provides sufficient power to the device 10) with a limited number of cartridges and, thereafter, the entire device, including the control body 300, may be discarded. Alternatively, the cartridge 200, control body 300, and/or atomizer assembly 400 may be reusable. For example, the control body 300 may have a replaceable power source (e.g., a replaceable battery) such that the device 10 may be reused through a number of power source exchanges and with many cartridges. Similarly, the device 10 may be rechargeable and thus may be combined with any type of recharging technology. For example, the device 10 may have a replaceable battery or a rechargeable battery, solid-state battery, thin-film solid-state battery, rechargeable supercapacitor or the like, and thus may be combined with any type of recharging technology, including connection to a wall charger, connection to a car charger (i.e., cigarette lighter receptacle), and connection to a computer, such as through a universal serial bus (USB) cable or connector (e.g., USB 2.0, 3.0, 3.1, USB Type-C), connection to a photovoltaic cell (sometimes referred to as a solar cell) or solar panel of solar cells, a wireless charger, such as a charger that uses inductive wireless charging (including for example, wireless charging according to the Qi wireless charging standard from the Wireless Power Consortium (WPC)), or a wireless radio frequency (RF) based charger. An example of an inductive wireless charging system is described in U.S. Pat. App. Pub. No. 2017/0112196 to Sur et al., which is incorporated herein by reference in its entirety. In some implementations, the control body 300 may be inserted into and/or coupled with a separate charging station for charging a rechargeable battery of the device 10. In some implementations, the charging station itself may include a rechargeable power source that recharges the rechargeable battery of the device.

Some additional examples of possible power sources are described in U.S. Pat. No. 9,484,155 to Peckerar et al., and U.S. Pat. App. Pub. No. 2017/0112191 to Sur et al., the disclosures of which are incorporated herein by reference in their respective entireties. Reference also is made to the control schemes described in U.S. Pat. No. 9,423,152 to Ampolini et al., which is incorporated herein by reference in its entirety.

In another example implementation, the cartridge 200 separately or in combination with the atomizer assembly 400 may comprise a disposable single-use cartridge. For example, the reservoir chamber 210 of the cartridge 200 along with or separately from the operably engaged atomizer assembly 400 may include a limited amount of aerosol precursor composition therein to provide for many of the sensations (e.g., inhalation and exhalation rituals, types of tastes or flavors, organoleptic effects, etc.) of smoking a particular amount of traditional types of smoking articles (e.g., cigarettes, cigars, pipes, etc.). In some example implementations, the cartridge 200 may include a particular amount of aerosol precursor composition therein equivalent to the amount of traditional types of smoking articles one would consume to obtain the sensations of smoking a typical amount of traditional types of smoking articles (e.g., a typical package of cigarettes—i.e., twenty (20) cigarettes). Additionally or alternatively, the cartridge 200 and the control body 300 may be securely engaged with one another so as to prevent tampering and/or manipulation of the aerosol precursor composition stored within the reservoir chamber 210. Although FIGS. 3A and 3B illustrate single reservoir chamber, one of ordinary skill in the art may appreciate that the aerosol delivery device 10 may include a cartridge defining any number of reservoir chambers 210. In some aspects, components of an aerosol precursor composition may be separated and compartmentalized in distinct reservoirs.

The cartridge 200 comprises, in some example implementations, an outer housing formed of an outer wall 201. The outer housing has a closed mouth end 202 and an opposing connecting end 204. The outer wall 201 extends from the mouth end 202 to the connecting end 204 along a direction parallel to the longitudinal axis Y of the aerosol delivery device 10. The connecting end 306 of the control body 300 may be operably engaged with the cartridge 200 about the connecting end 204 thereof.

The outer housing of the cartridge 200 may be formed of any suitable material including a moldable plastic material such as, for example, polycarbonate, polyethylene, acrylonitrile butadiene 25 styrene (ABS), polyamide (Nylon), or polypropylene. In other example implementations, the outer housing may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof. In some example implementations, a transparent or translucent window or other indicator (e.g., an LED) may be formed in the outer housing to provide a visual indicator of a quantity of aerosol precursor composition remaining within the reservoir chamber 210 of the cartridge 200.

In some example implementations, the cartridge 200 comprises a storage portion defining the reservoir chamber 210 and a mouthpiece portion. The mouthpiece portion may include a mouthpiece 206 disposed proximate the mouth end 202 of the cartridge 200. Further, in some implementations, the mouthpiece portion may comprise a single-use device. A single use component for use with a control body is disclosed in U.S. Pat. No. 8,910,639 to Chang et al., which is incorporated herein by reference in its entirety. The mouthpiece 206 may define a mouthpiece opening 207 in fluid communication with the reservoir chamber 210. In some implementations, the mouthpiece portion disposed proximate the mouth end 202 of the cartridge 200 may include a tapered portion having a smaller diameter than other portions (e.g., reservoir chamber 210) of the cartridge 200. The mouthpiece portion of some implementations is separable from the storage portion of the cartridge 200, while in other implementations, the mouthpiece portion may be integral with the storage portion of the cartridge 200. In any event, the mouthpiece portion and the storage portion of the cartridge 200 may be made of the same material or different materials. In various implementations comprising a separable mouthpiece, the mouthpiece portion may be coupled to the storage portion in a variety of ways, including, for example, via one or more of a snap-fit, interference fit, screw thread, magnetic, and/or bayonet connection. In other implementations, the mouthpiece portion may be integral with the storage portion and thus may not be separable.

According to some implementations, the aerosol delivery device 10 may include a mouthpiece channel 216 that is formed of an outer wall 217 disposed within the reservoir chamber 210. For example, the mouthpiece channel 216 may be formed of the outer wall 217 extending at least partially along a length of the reservoir chamber 210. The outer wall 217 may be disposed interior to the outer wall 201 of the cartridge 200. Additionally, the mouthpiece channel 216 may define an open first end 214 disposed proximate to the mouth end 202 of the cartridge 200 and an open terminal end 219. The open first end 214 may provide for egress of formed aerosol from the aerosol delivery device 10. In particular, the open first 214 of the mouthpiece channel 216 may be configured to be in fluid communication with the mouth end 202 of the outer wall 201, and in particular, in fluid communication with the mouthpiece opening 207 defined in the mouth end 202 of the cartridge 200.

As shown in FIG. 3A, the mouthpiece channel 216 may be substantially tubular and cylindrical in shape. Additionally, the mouthpiece channel 216 may extend from the mouthpiece opening 207 to the open terminal end 219 of the mouthpiece channel 216 along a direction parallel to the longitudinal axis Y of the aerosol delivery device 10. In some aspects, the mouthpiece channel 216 may taper as it extends from the open first end 214 to the open terminal end 219 of the mouthpiece channel 216.

In some example implementations, the mouthpiece portion (e.g., in the mouthpiece 206) and/or the storage portion of the cartridge 200 may include a filter configured to receive the aerosol therethrough in response to the draw applied to the cartridge 200. In various implementations, the filter may be provided, in some aspects, as a circular disc radially and/or longitudinally disposed proximate the open first end 214 or the open terminal end 219 of the mouthpiece channel 216. In this manner, upon a draw on the cartridge 200, the filter may receive the aerosol flowing through mouthpiece channel 216. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the mouthpiece 206 may include a filter that may also provide a flavorant additive. In some implementations, a filter may include one or more filter segments that may be replaceable. For example, in some implementations one or more filter segments may be replaceable in order to customize a consumer's experience with the device, including, for example, filter segments that provide different draw resistances and/or different flavors. Some examples of flavor adding materials and/or components configured to add a flavorant can be found in U.S. Pat. App. Pub. No. 2020/0352256 to Hejazi; U.S. Pat. App. Pub. No. 2019/0289909 to Hejazi; and U.S. Pat. App. Pub. No. 2020/0288787 to Hejazi, each of which is incorporated by reference herein in its entirety.

In some example implementations, the outer wall 217 that forms the mouthpiece channel 216 may include an exterior surface, and the outer wall 201 may include an interior surface 212. The interior surface 212 of the outer wall 201 that forms the cartridge 200 in cooperation with the exterior surface of the outer wall 217 that forms the mouthpiece channel 216 may define, in part, the reservoir chamber 210 configured to retain an amount of the aerosol precursor composition therein.

The aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some implementations, an aerosol precursor composition may produce a visible aerosol upon the application of sufficient heat thereto (and cooling with air, if necessary), and the aerosol precursor composition may produce an aerosol that is "smoke-like." In other implementations, the aerosol precursor composition may produce an aerosol that is substantially non-visible but is recognized as present by other characteristics, such as flavor or texture. Thus, the nature of the produced aerosol may be variable depending upon the specific components of the aerosol delivery component. The aerosol precursor composition may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the aerosol precursor composition may comprise an active compound naturally existing in a botanical, obtained synthetically. The aerosol precursor composition may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens.*

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the aerosol precursor composition and/or those regions of the smoking article where an aerosol is generated. In some implementations, such agents may be supplied directly to a heating cavity or region proximate to the heat source or are provided with the aerosol precursor composition. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some implementations, the flavor comprises flavor components of cucumber, blueberry, citrus fruits and/or redberry. In some implementations, the flavor comprises eugenol. In some implementations, the flavor comprises flavor components extracted from tobacco. In some implementations, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Flavoring agents may also include acidic or basic characteristics (e.g., organic acids, such as levulinic acid, succinic acid, pyruvic acid, and benzoic acid). In some implementations, flavoring agents may be combinable with the elements of the aerosol precursor composition if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the aerosol precursor composition. Organic acids particularly may be able to be incorporated into the aerosol precursor composition to affect the flavor, sensation, or organoleptic properties of medicaments, such as nicotine, that may be able to be combined with the aerosol precursor composition. For example, organic acids, such as levulinic acid, lactic acid, pyruvic acid, and benzoic acid may be included in the aerosol precursor composition with nicotine in amounts up to being equimolar (based on total organic acid content) with the nicotine. Any combination of organic acids may be suitable. For example, in some implementations, the aerosol precursor composition may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the aerosol precursor composition. Various additional examples of organic acids employed to produce an aerosol precursor composition are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In some example implementations, the atomizer assembly 400 may be arranged about the connecting end 202 of the outer housing. As illustrated in FIG. 4, the atomizer assembly 400 may comprise a base 402 defining a first surface 404 and an opposing second surface 406. The first surface 404 of the base 402 may be engageable with the connecting end 202 of the outer housing of the cartridge 200. The base 402 may, in some example implementations, be insertable into the connecting end 202 of the cartridge 200, or may otherwise be fixedly or removably attached to the cartridge 200 using press fit engagement, threaded engagement, interference fit engagement, magnetic engagement, bayonet lock engagement, snap fit, and/or the like. The base 402 may also be securely affixed and/or attached to the cartridge 200 through ultrasonic welding and/or the like. Although the base 402 and the cartridge 200 are illustrated as being separate members, the base 402 and the cartridge 200 may be integrally formed with one another. As shown in FIG. 4, for example, the base 402 comprises one or more protrusions 408 (two being shown in FIG. 4) that may engage a recess, groove, or other structure (not shown) of the interior surface 212 of the outer wall 201. In some other example implementations, other mechanisms for engaging the base 402 with the cartridge 200 may be contemplated such as, for example, retention spheres, one or more resilient members, such as, for example, one or more O-rings, and/or other retaining features that include one or more resilient features that engage the interior surface 212 of the cartridge. In other implementations, the cartridge 200 may include one or more protrusions and/or spring features and corresponding detent features configured to retain the base 402. In still other implementations, the interior surface 212 of the cartridge 200 may have a decreasing diameter (and/or one or more portions having a decreased diameter) that May be configured to retain the base 402 therein. In other implementations, the base 402 and/or the cartridge 200 may include actively retractable features (e.g., features that are actively retractable by a consumer), one or more wedge features, and/or one or more features that may create a releasable connection between the base 402 and the cartridge 200. For example, in some implementations, the cartridge 200 and the base 402 may have a releasable screw-type connection. Combinations of two or more of these retaining features may also be used.

In some alternative implementations, the base 402 is engageable with the receiving chamber 302 of the control body 300, such that the connecting end 202 of the cartridge 200 may be engageable with the base 402 after insertion into the control body 300. Regardless, when the base 402 is engaged with the cartridge 200, and the cartridge 200 is engaged with the control body 300, the base 402 may be disposed proximate a connecting end 302 of the control body 300 along the direction of the Y axis of the device 10.

In the example implementation shown in FIGS. 3A and 3B, when the base 402 is engageable (e.g., insertable) into the connecting end 202 of the outer housing of the cartridge 200, the reservoir chamber 210 containing the aerosol precursor composition is defined between the interior surface 212 of the outer wall 201 that forms the cartridge 200 and the first surface 404 of the base 402. Optionally, the reservoir chamber 210 is defined between the interior surface 212 of the outer wall 201 that forms the cartridge 200, the exterior surface of the outer wall 217 that forms the mouthpiece channel 216, and the first surface 404 of the base 402.

Various other details with respect to the components configured for coupling the cartridge 200 and the control body 300, are provided, for example, in U.S. Pat. App. Pub. No. 2014/0261495 to Novak et al., which is incorporated herein by reference in its entirety.

The control body 300 may likewise comprise a cartridge retention assembly configured to retain the cartridge 200 with or without the base 402 in the use position. In one example implementation, and as shown, the cartridge retention assembly comprises magnetic plugs 410 that are arranged proximate to the second surface 406 of the base 402 and engage corresponding magnetic elements (not shown) in the receiving chamber 302 of the control body 300 to temporarily "lock" the cartridge 300 in place within the receiving chamber 302 of the control body 300. For example, the receiving chamber 302 may be made of a ferromagnetic material, which the magnetic plugs 410 are attracted to. The magnetic plugs 410 may be arranged such that an exposed portion is substantially flush with the second surface 406 of the base 402 (as shown), may be recessed within the second surface 406 of the base 402, and/or may extend at least partially out of the second surface 406 of the base 402.

In some other example implementations, the cartridge retention assembly comprises a spring-loaded latching mechanism, the base 402 as engaged with the cartridge 200 is pushed into and fully received within the receiving chamber 302. In other example implementations, other retaining features may be used. For example, in some implementations one or more retention spheres may form part of a cartridge retention assembly. In other implementations, a cartridge retention assembly may comprise one or more resilient members, such as, for example, one or more O-rings, and/or other retaining features that include one or more resilient features that extend into the receiving chamber 302 in order to engage a portion of the outer wall 201 of the cartridge 200 and/or the base 402. In other implementations, the outer wall 201 of the cartridge 200 and/or the receiving chamber 302 may include one or more protrusions and/or spring features and corresponding detent features configured to retain the cartridge 200 and/or the base 402 in the receiving chamber 302. In still other implementations, an inner surface of the receiving chamber 302 may have a decreasing diameter (and/or one or more portions having a decreased diameter) that may be configured to retain the cartridge 200 and/or the base 402 in the receiving chamber 302. In other implementations, the control body 300 may include actively retractable features (e.g., features that are actively retractable by a consumer) configured to engage the cartridge 200 to retain it in the receiving chamber 302. In other implementations, the control body 300 may include one or more wedge features configured to engage and retain the cartridge 200 and/or the base 402 in the receiving chamber 302. In still other implementations, one or more other features of the cartridge 200/base 402 and/or one or more features of the control body 300 may create a releasable connection between the receiving chamber 302 and the cartridge 200/base 402. For example, in some implementations, the cartridge 200/base 402 and the receiving chamber 302 may have a releasable screw-type connection. Combinations of two or more of these retaining features may also be used. Various other details with respect to the components configured for coupling the cartridge 200 and the control body 300, are provided, for example, in U.S. Pat. App. Pub. No. 2014/0261495 to Novak et al., which is incorporated herein by reference in its entirety.

In various implementations, one or more components of a cartridge retention assembly may be made of any material, including for example, but not limited to, metal or plastic materials. For example, some implementations may include one or more components of a cartridge retention assembly that are made of a metal material such as, for example, stainless steel, aluminum, brass, copper, silver, gold, bronze, titanium, various alloys, etc. In some implementations, one or more components of a cartridge retention assembly may be made of a moldable plastic material such as, for example, polycarbonate, polyethylene, acrylonitrile butadiene styrene (ABS), polyamide (Nylon), or polypropylene. In some implementations, one or more components of a cartridge retention assembly may be made of a different material, such as, for example, a different plastic material, a different metal material, a graphite material, a glass material, a ceramic material, a natural material (such as, but not limited to, a wood material), a composite material, or any combinations thereof.

In some implementations, the control body 300 may include an ejection mechanism. In such a manner, the ejection mechanism may be configured to eject a cartridge and/or base from the control body. In one implementation, the ejection mechanism may comprise a spring-loaded plate and latch mechanism, wherein the spring-loaded plate engages the cartridge 200/base 402, directly or indirectly, such that in the use position, the spring is compressed and is held in place with a latch. The latch may be operatively connected to a consumer activated button, which is configured to release the latch when activated by the consumer. In some implementations, the ejection mechanism comprises part of the spring-loaded cartridge retention assembly. In other implementations, however, the ejection mechanism may comprise an independent mechanism. The ejection mechanism may be activated via a button located on the control body 300. In other implementations, however, the ejection mechanism may be activated in other ways.

In some implementations, the base 402 may comprise anti-rotation features that substantially prevent relative rotation between the cartridge 200 and the control body 300 as disclosed in U.S. Pat. App. Pub. No. 2014/0261495 to Novak et al., which is incorporated herein by reference in its entirety. The base 402 may also comprise sealing features configured to substantially limit and/or prevent the aerosol precursor composition and/or any aerosol formed from traversing the anti-rotation features. The anti-rotation features and the sealing features may be combined into a single structure or may be separate.

For example, the sealing features may include gasket(s), O-ring(s), ridges, flanges, and/or the like that extend circumferentially about a peripheral surface of the base 402 and that engage the interior surface 212 of the outer wall 201 of the cartridge 200. As shown in FIG. 4, for example, the sealing features comprises an O-ring 412 received in a circumferentially extending groove of the base 402. The O-ring 412 may thus act to seal the atomizer assembly 400 from the control body 300. The O-ring 412 may also act to resist decoupling of the base 402 from the cartridge 200. The O-ring 412 may be any type of elastomeric material, or may be any other type of similar material that provides similar benefits. Thus, the O-ring 412 may substantially prevent the aerosol and/or the aerosol precursor composition from escaping the aerosol delivery device 10 via means other than the mouthpiece channel 216 and/or the open first end 214 of the mouthpiece channel 216.

Turning now to FIG. 5, the base 402 may define a recess 414 formed in the first surface 404 of the base 402. The recess 414 may be formed as a depression in the first surface 404 of the base 402 that extends towards to the second surface 406 of the base 402. The recess 414 may extend to varying depths within the base 402, such that one or more plateaus of varying depths within the base 402 are defined. As shown in FIG. 5, there are five different plateaus defined with the recess 414, with a bottom surface 416 being at a lowest depth. One or more openings 418 may be defined in the bottom surface 416 of the recess 414 and may extend therethrough to the second surface 406. There may be one, two, three, four, five, or more opening(s) 418. Where there is more than one opening 418, each of the openings 418 may have the same or different shapes and diameters. In some example implementations, the openings 418 may be configured to provide for fluid communication between the mouthpiece channel 216 and the control body 300 when the atomizer assembly 400 is engaged with the connecting end 202 of the outer wall 201. In particular, the opening(s) 418 may allow for air entering the control body 300 through one or more air intake orifice(s) 312 defined in the outer shell 304 of the control body 300 to entrain with the formed aerosol and be delivered to the consumer through the mouthpiece channel 216 upon draw on the device 10. Thus, the air intake orifice 312 defined in the control body 300 and the openings 418 of the base 402 may be in fluid communication through a defined flow path.

Figure 7:
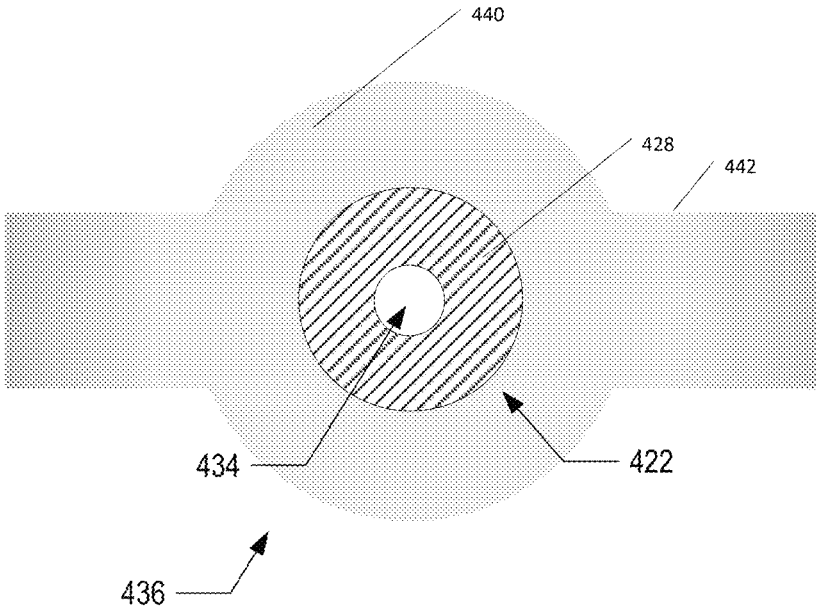
FIG. 7 illustrates a side view of a first sealing member and a liquid transport element of a reservoir chamber sealing arrangement for an atomizer assembly for an aerosol delivery device with improved sealing arrangement according to some example implementations of the present disclosure.

Returning to FIG. 4, one or more elements of the atomizer assembly 400 may be arranged about the base 402. For example, the atomizer assembly 400 may comprise an atomizer 420 arranged about the first surface 404 of the base 402 to atomize the aerosol precursor composition and form an aerosol. A liquid transport element 422 may be arranged about the first surface 404 of the base 402 and define opposing first and second ends 424, 426 with exposed end surfaces 428 (FIG. 7) that are in fluid communication with the reservoir chamber 210 so as to direct the aerosol precursor composition from the reservoir chamber 210 through the end surfaces 428 of the liquid transport element 422 and into contact with the atomizer 420. The atomizer 420 may be arranged between the first and second ends 424, 426 of the liquid transport element 422. The liquid transport element 422 may include wicking and/or porous materials that provide for movement of the aerosol precursor composition therethrough (e.g., via capillary action), such that the aerosol precursor composition may be drawn proximate to the atomizer 420.

As shown in FIG. 4, for example, the atomizer 420 may comprise a wire coil 430 having a plurality of turns and that provides resistive heating. The atomizer 420 may be integrally formed with first and second electrical terminals 422A, 422B (e.g., negative and positive terminals), or may be operably engaged with and in electrical communication with the first and second electrical terminals 422A, 422B. For example, portions of the atomizer 420 may be welded, soldered, brazed, and/or the like to the respective first and second electrical terminals 422A, 422B. For example, where the coil 430 defines a wire, openings 424 may be defined through the base 402 (e.g., as shown in FIG. 5, defined on a second deepest surface in the recess 414 and extending to the second surface 406). This may allow for the first and second electrical terminals 422A, 422B to extend from the first surface 404 of the base 402 to the second surface 406 of the base 402. In some example implementations, the first and second electrical terminals 422A, 422B are in operable engagement with and/or indirectly or directly contact electrical contacts 426 proximate the second surface 406 of the base 402. The electrical contacts 426 may provide electrical communication between the atomizer 420 and the power source of the control body 300 when the cartridge 200 is engaged with the control body 300. The electrical contacts 426 may be defined in the second surface 406 of the base 402 for providing electrical communication between the atomizer 420 and the power source in the control body 300 when the cartridge 200 is engaged with the control body 303. The contacts 426 may be arranged such that an exposed portion is substantially flush with the second surface 406 of the base 402 (as shown), may be recessed within the second surface 406 of the base 402, and/or may extend at least partially out of the second surface 406 of the base 402. Correspondingly, the control body 300 may include electrical contacts (not shown) configured to contact the electrical contacts 426 of the base 402 such that the electrical contacts 426 of the base 402 respectively come into contact with the contacts of the control body 300 when the control body 300 and the cartridge 200 are joined together to establish an electrical connection therebetween. Thereby, the first and second electrical terminals 422A, 422B are configured to engage the coil 430 of the atomizer 420 and to form an electrical connection with the control body 300 when the cartridge 200 is connected thereto.

In some example implementations, the wire material may include Kanthal (FeCrAl), Nichrome, Molybdenum disilicide ($MoSi_2$), Molybdenum disilicide doped with Aluminum ($Mo(Si,Al)_2$), ceramics (e.g., a positive temperature coefficient ceramic), titanium and/or related alloys in some aspects, although various other materials may be employed in other aspects. According to some aspects, the coil 430 may be formed by winding the wire about the liquid transport element 422 as described in U.S. Pat. No. 9,210,738 to Ward et al., which is incorporated herein by reference in its entirety. However, various other aspects of methods may be employed to form the atomizer 420, and various other components may be employed in the atomizer 420. For example, the atomizer 420 may be configured to heat the aerosol precursor composition disposed within the liquid transport element 422 via radiant heating, as described in U.S. patent application Ser. No. 14/808,405, filed Jul. 24, 2015; Ser. No. 14/958,651, filed Dec. 3, 2015, the contents of which are incorporated herein in their entirety by reference. In another aspect, the atomizer 420 may be configured to heat the aerosol precursor composition via inductive heating, as described in U.S. patent application Ser. No. 14/958,651, filed Dec. 3, 2015; Ser. No. 14/934,763, filed Nov. 6, 2015, the contents of which are incorporated herein in their entirety by reference. Although the atomizer 420 is illustrated as a wire having the plurality of coils 430 wound about the liquid transport 422 element, additional forms for the atomizer 420 are also encompassed by this disclosure, such as an atomizer in the form of a foil, a foam, discs, spirals, fibers, wires, films, yarns, strips, a mesh, ribbons, and/or cylinders. Other manners of aerosolizing the aerosol precursor composition other than heating are also contemplated by this disclosure. For example, the atomizer 420 may be a piezoelectric mesh that vibrates to atomize the aerosol precursor composition, an ultrasonic atomizer that uses ultrasonic waves to create the aerosol, and the like.

The atomizer 420 may be in direct or indirect contact with the liquid transport element 422. For example, and as shown, the atomizer 420 may be in direct contact with an outer surface 432 defined by the liquid transport element 422. The outer surface 432 may longitudinally extend between the end surfaces 428. The plurality of turns of the coil 430 of the atomizer 420 may be wound about the outer surface 432 and between the end surfaces 428 of the liquid transport element 422. In this regard, the liquid transport element 422 may be configured to draw the aerosol precursor composition retained in the reservoir chamber 210 into direct contact with the coils 430.

The liquid transport element 422 may comprise a porous monolith. In one example implementation, the liquid transport element 422 may comprise a porous monolith composed of a single element or multiple elements coupled to one another such that they form a unitary element, although in other example implementations, the liquid transport element 422 is composed of two or more separable elements such that the liquid transport element 422 is not considered 'monolithic'. As used herein, a "porous monolithic material" or "porous monolith" is intended to mean comprising a substantially single unit which, in some implementations, may be a single piece formed, composed, or created without joints or seams and comprising a substantially, but not necessarily rigid, uniform whole. In some implementations, a monolith according to the present disclosure may be undifferentiated, i.e., formed of a single material, or may be formed of a plurality of units that are permanently combined, such as a sintered conglomerate. Thus, in some implementations the porous monolith may comprise an integral porous monolith. In some example implementations, the porous monolith defines a central opening 434 (FIG. 7) that extends between the end surfaces 428 of the liquid transport element 422.

In some other example implementations, the liquid transport element 422 may be nonfibrous, meaning the liquid transport element 422 is formed from a solid material having a microtextured surface rather than a surface formed by a plurality of bundled fibers. As notes herein, "microtextured" refers to a surface having topographical three-dimensional features at the micro-meter scale (e.g., a plurality of three-dimensional surface features having an average height of less than about 250 microns) that are discontinuous in appearance such that the surface includes multiple concave and convex portions. Non-limiting examples include a ceramic material, particularly a silicon-based material, such as a silicon nitride or silicon dioxide material. Other materials, however, such as glass or quartz can be used. Certain thermoplastic materials, such as cyclic olefin copolymers (COC), also can be used.

In some example implementations, the liquid transport element 422 comprises a cylindrical shape, such that the outer surface 432 is curved. However, in some other example implementations, the liquid transport element 422 may comprise a rectangular prism shape, a conical shape, a triangular prism shape, or another type of shape, such that the outer surface 432 is not curved or only partially curved. In some other example implementations, the liquid transport element 422 is U-shaped, V-shaped, T-shaped, or any other like shape.

Returning back to FIG. 4, the atomizing assembly 400 may further comprise a reservoir chamber sealing arrangement comprising a first sealing member 436. One example implementation of the first sealing member 436 is illustrated in greater detail in FIG. 6. The first sealing member 436 may be arranged about the first surface 404 of the base 402 and receiving the opposing first and second ends 424, 426 of the liquid transport element 422 to circumferentially seal the opposing first and second ends 424, 426 of the liquid transport element 422 and expose the end surfaces 428 thereof, while simultaneously laterally (i.e., along a lateral axis X of the device 10 (FIG. 3B)) and axially (i.e., along a longitudinal axis Z of the liquid transport element 422 extending between the first and second ends 424, 426 (FIG. 3A)) position the atomizer 420 within the cartridge 200. As such, the reservoir chamber 210 may be sealed by the reservoir chamber sealing arrangement except at the end surfaces 428 of the liquid transport element 422.

The first sealing member 436 may be arranged within the recess 414 formed in the first surface 404 of the base 402. In particular, the first sealing member 436 may be arranged within a first plateau 438 in the recess 414, which is the shallowest compared to the others. The first plateau 438 may be formed such that it has a shape matching the shape of the first sealing member 436. As such, the first sealing member 436 may be in direct contact with the first plateau 438 of the base 402. Otherwise, the first sealing member 436 may be arranged on top of or proximate to the first surface 404 of the base 402, such that the first sealing member 436 is indirectly (e.g., a small amount of clearance is provided between the first sealing member 436 and the first surface 404, a substrate is provided therebetween, etc.) in contact with the first plateau 438 of the base 402. In some alternative implementations, the first sealing member 436 is arranged proximate to the opposing second surface 406 of the base 402.

In some example implementations, the first sealing member 436 comprises a monolithic structure that is formed as a single or unitary member, or from one or more elements that are so fused together so as to create a single or unitary structure. In the depicted implementation, the first sealing member 436 is made of a molded elastic polymeric material, such as silicone. In the implementations where the first sealing member 436 is silicone, a compression range (which may be determined based on the shore hardness of the silicone) may be targeted to be maintained within a tolerance stack-up that accommodates tolerance variation of the surrounding parts of the atomizing assembly 400. For example, where the first sealing member 436 is a 2 mm thick gasket of 60A silicone, the compression range may be targeted at 15% nominal compression. The elements surrounding the first sealing member 436 (e.g., flow director 446) should then be designed to compress the first sealing member 436 down to a thickness of 1.7 mm (nominal) and toleranced to keep the compression within a 10%-20% compression range.

Figure 6:
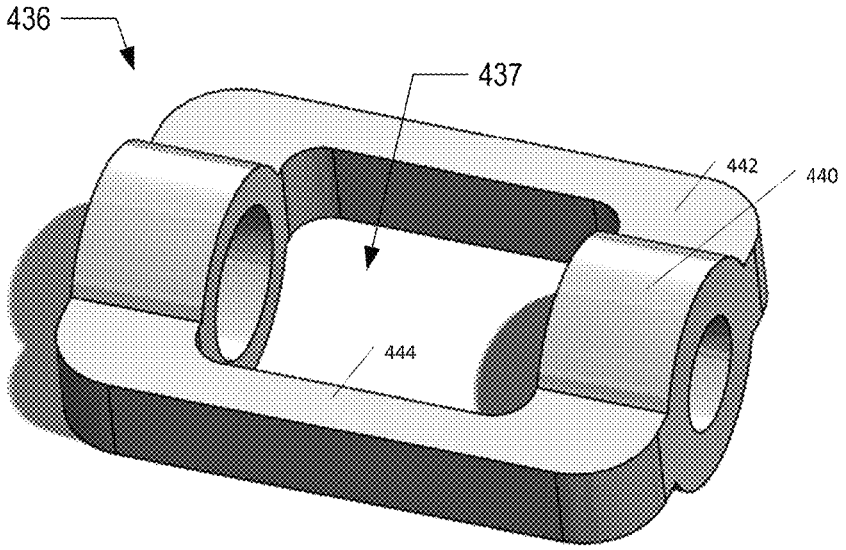
FIG. 6 illustrates a top perspective view of a first sealing member of a reservoir chamber sealing arrangement for an atomizer assembly for an aerosol delivery device with improved sealing arrangement according to some example implementations of the present disclosure.
Figure 8:
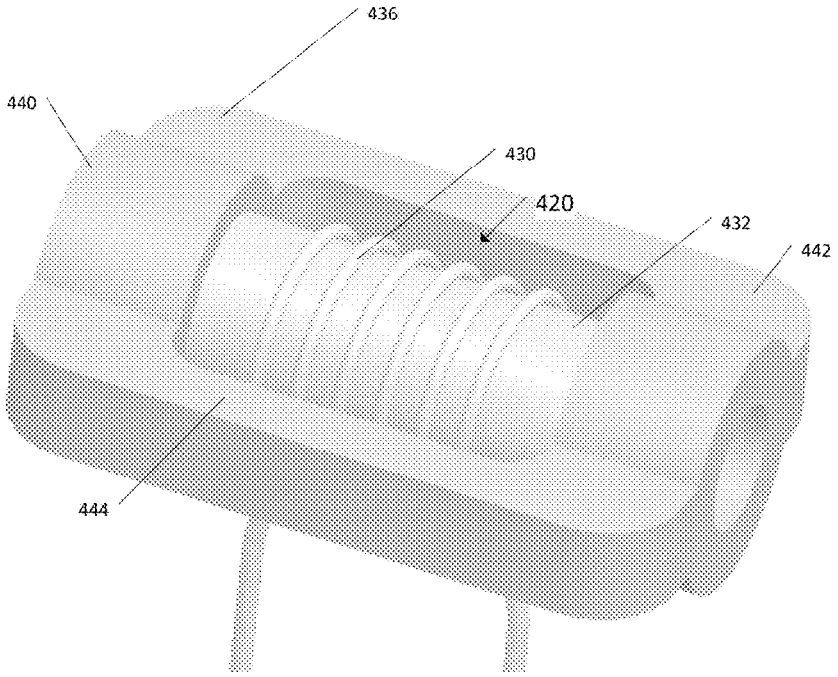
FIG. 8 illustrates a top perspective view of a first sealing member, an atomizer, and a liquid transport element of a reservoir chamber sealing arrangement for an atomizer assembly for an aerosol delivery device with improved sealing arrangement according to some example implementations of the present disclosure.

As shown in FIG. 6, the first sealing member 436 comprises a pair of opposing annular members comprising receptacles 440 having openings arranged therein (e.g., substantially centrally), with opposite connecting flanges 444 (FIG. 9) defining lateral surfaces 442 extending between the open receptacles 440, so as to collectively define a circumferential perimeter of the first sealing member 436. A central opening 437 may be defined inside the circumferential perimeter of the first sealing member 436. The open receptacles 440 may be in the form of open cylinders, although other shapes may define the open receptacles 440. As shown in FIG. 6, for example, the open receptacles 440 are in the form of open cylinders. One of the first and second ends 424, 426 of the liquid transport element 422 may be at least partially or fully received in one of the open receptacles 440 such that the liquid transport element 422 is laterally and axially positioned within the cartridge 200 and the opposing first and second ends 424, 426 of the liquid transport element 422 are circumferentially sealed by the open receptacles 440 and the end surfaces 428 are exposed. The coils 430 of the atomizer 420 may thus be arranged between the open receptacles 440 and within the central opening 437 of the first sealing member 436 when the liquid transport element 422 is received by the first sealing member 436, as shown in FIG. 8.

Figure 9:
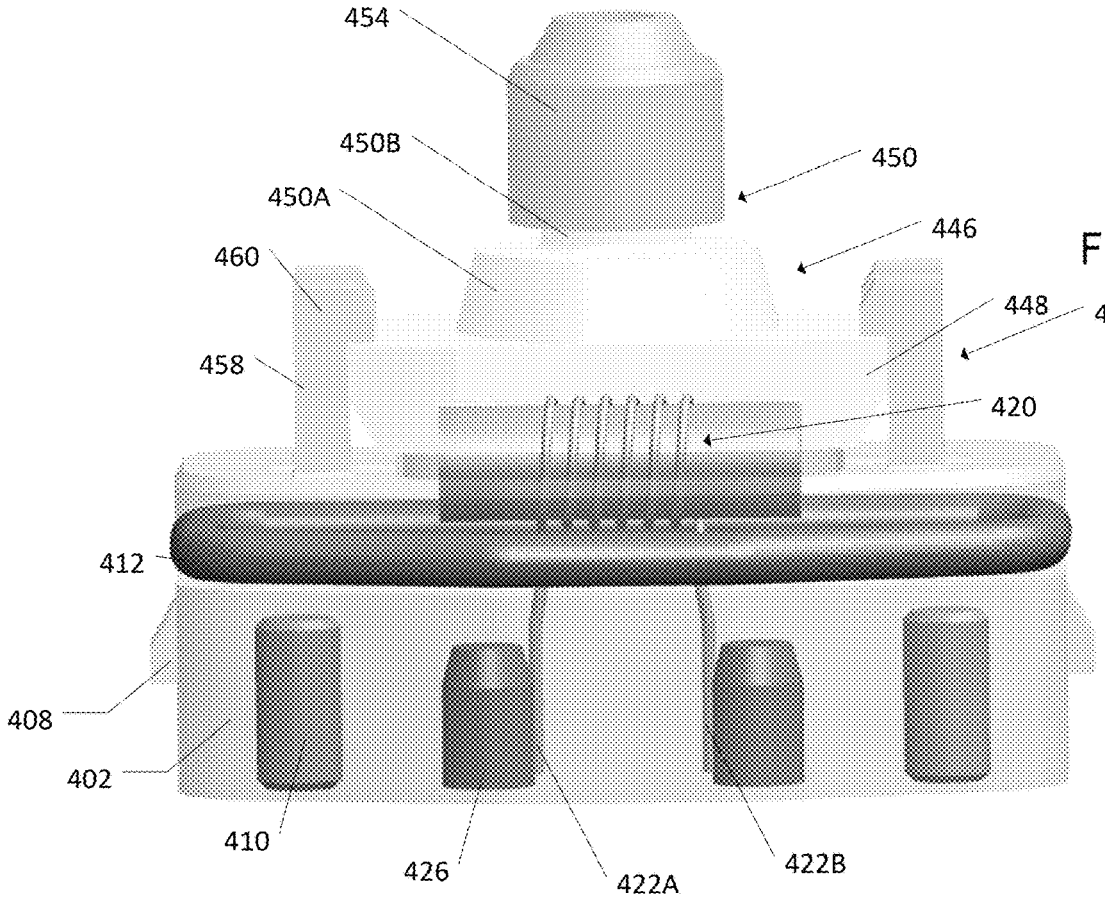
FIG. 9 illustrates a front view of an atomizer assembly including a reservoir chamber sealing arrangement for an aerosol delivery device with improved sealing arrangement according to some example implementations of the present disclosure.

Referring now to FIG. 9, the reservoir chamber sealing arrangement may further comprise a flow director 446 defining a base portion 448 with opposing top and bottom planar surfaces with a flow tube 450 extending from a top planar surface thereof. The flow tube 450 may comprise a substantially cylindrical shape with one or more portions. As shown in FIG. 9, for example, there are two portions of the flow tube 450—a first portion 450A in contact with the base portion 448 and a second portion 450B extending from the first portion 450A. The first portion 450A may have a diameter greater than a diameter of the second portion 450B, but smaller than a diameter of the base portion 448. As shown in FIGS. 3A and 3B, the terminal end 219 of the mouthpiece channel 216 may be in contact with the first portion 450A. In some example implementations, a circumference of the mouthpiece channel 216 (and specifically the terminal end 219 thereof) may have a substantially same diameter as that of the first portion 450A, although the two diameters may also differ. As shown in FIGS. 3A and 3B, for example, the second portion 450B of the flow director 446 is inserted into the open terminal end 219 of the mouthpiece channel 216, although in some example implementations, the open terminal end 219 of the mouthpiece channel 216 may be inserted into the flow tube 450 or the two may abut one another. Alternatively, the mouthpiece channel 216 may be configured to directly engage another component of the reservoir chamber sealing arrangement.

The flow director 446 may comprise an opening defined centrally in the base portion 448 and extending from the top planar surface to the bottom planar surface and through the flow tube 450 aligned therewith. The opening may have a constant inner diameter along a length of the flow director 446 extending along the Y direction. However, and as illustrated in FIG. 3A, the opening has an inner diameter that varies along the length of the flow director 446. For example, and as shown in FIG. 3A, an inner diameter of the opening in the base portion is greater than an inner diameter of the opening in the first portion 450A and in the second portion 450B. There, the opening has a constant inner diameter in the base portion 448, tapers to a narrower inner diameter in the first portion 450A, and has a constant inner diameter in the second portion 450B, which is smaller than the inner diameter in the base portion 448. Thus, the opening in the flow director 446 may act as a funnel so as to funnel the formed aerosol from the atomizer and toward the mouthpiece channel 216. In this example implementation, the flow tube 450 may be aligned and in fluid communication with the atomizer 420 so as to direct the formed aerosol towards the mouth end 202 of the outer housing of the cartridge 200. The aerosol may be formed in an aerosolization region 452 proximate the liquid transport element 422, and defined between the atomizer 420 arranged about the liquid transport element 422 and the open terminal end 219 of the of the mouthpiece channel 216. In particular, the aerosolization region 452 may be proximate the opening formed in the bottom planar surface of the base portion 448 of the flow director and the atomizer 420.

The flow director 446 may be arranged such that the first sealing member 436 is disposed between the bottom planar surface of the flow director 446 and the first surface 404 of the base 402. For example, the circumferential perimeter (i.e., the open receptacles 440 arranged centrally with opposite connecting flanges 444 extending between the open receptacles 440) of the first sealing member 436 may be directly and sealingly engaged with the bottom planar surface of the base portion 448 of the flow tube 450, such that upon compression of the flow tube 450 against the first sealing member 436 and the first surface 404 of the base 402, the reservoir chamber 210 is sealed except at the exposed end surfaces 428 of the liquid transport element 422. To this end, the bottom planar surface of the base portion 448 may be shaped and sized so as to create a seal between the circumferential perimeter and the outer surface 432 of the liquid transport element 422. In this manner, the reservoir chamber 210 is sealed by the reservoir chamber sealing arrangement at an interface between the base portion 448 of the flow director 446 and the circumferential perimeter (i.e., flanges 444 and receptacles 440 of the liquid transport element 422) except at the exposed end surfaces 428 of the liquid transport element 422. As such, a single, unitary part creates a seal for the reservoir chamber (e.g., both a seal at the base portion 448 of the flow director 446 and a seal around the circumferential perimeter, except at the exposed end surfaces 428 of the liquid transport element 422).

Still referring to FIGS. 3A and 3B, the reservoir chamber sealing arrangement may also comprise a second sealing member 454 arranged at the open terminal end 219 of the mouthpiece channel 216 to provide a seal between the flow tube 450 and the mouthpiece channel 216. As shown, the second sealing member 454 may be arranged to at least partially or substantially surround the second portion 450B of the flow tube 450 and be inserted into the open terminal end 219 of the mouthpiece channel 216. In this manner, the second sealing member 454 may act as a seal between the reservoir chamber 210 and the mouthpiece channel 216 and mitigate/prevent aerosol precursor composition from the reservoir chamber 210 leaking into the mouthpiece channel 216, while also substantially preventing the formed aerosol from leaking out of the mouthpiece channel 216. The second sealing member 454 may be a same or similar material to the first sealing member 436, or may be a different material.

In order to retain the reservoir chamber sealing arrangement in position within the cartridge 200, the base 402 may further comprise a retaining member 456 extending from the first surface 404 thereof and engaging the flow director 446. The retaining member 456 may be arranged to compress the flow director 446 against the first sealing member 436 and the first surface 404 of the base 402, and thereby seal the reservoir chamber 210 except at the exposed end surfaces 428 of the liquid transport element 422. For example, and as shown in FIGS. 4 and 9, the retaining member 456 comprises one or more pairs of arms 458 extending substantially perpendicularly from the first surface 404 of the base 402 and a protrusion 460 extending toward a center of the base 402 (i.e., toward the longitudinal axis Y of the device 10). The protrusion 460 may engage the top planar surface of the base portion 448 of the flow director 4242 to compress the base portion 448 of the flow director 446 against the first sealing member 436 and the first surface 404 of the base 402, and thereby seal the reservoir chamber 210 except at the exposed end surfaces 428 of the liquid transport element 422, while simultaneously maintain the alignment of the flow tube 450 with the atomizer 420. In the depicted implementation, the retaining member 456 comprises two pairs of arms 458 located on opposing lateral ends such that together the arms 458 compress the flow director 446 against the first sealing member 436 and the first surface 404 of the base 402.

In some other example implementations, the retaining member 456 may comprise any other type of structure/arrangement capable of retaining the flow director 446 and/or the first sealing member 436 in alignment. For example, the retaining member 456 may be in direct engagement (e.g., via press-fit engagement, magnetic engagement, snap fit engagement, interference fit engagement, etc.) with the first sealing member 436 and/or the liquid transport element 422 and/or the atomizer 420. In this manner, the reservoir chamber sealing arrangement may be configured to substantially limit and/or prevent the aerosol precursor composition disposed within the reservoir chamber 210 from entering the control body 300 or the mouthpiece channel 216.

According to some aspects, when the mouthpiece channel 216 substantially abuts the flow tube 450 and/or is disposed within or surrounding the flow tube 450, operable engagement therebetween and the interface between the circumferential perimeter of the liquid transport element 422 may provide for a substantially air-tight seal or substantially fluid-tight seal except at the exposed ends 428 of the liquid transport element 422. This operable engagement may advantageously prevent and/or substantially limit aerosol, vapor and/or the like formed by the atomizer 420 from entering the reservoir chamber 210. Additionally or alternatively, this operable engagement may advantageously prevent and/or substantially limit the aerosol precursor composition retained within the reservoir chamber 210 from entering the mouthpiece channel 216, the openings 418, and/or the control body 300. Thus, when the atomizing assembly 400 is engaged with the connecting end 202 of the outer wall 201 of the cartridge 200, and the control body 300 is operably engaged with the cartridge 200 about the connecting end 202 of the outer housing, the mouthpiece channel 216 substantially abuts the flow tube 450, and the openings 418 in the bottom surface 416 of the recess 414 may provide for fluid communication between the mouthpiece channel 216 and the control body 300 such that the air entering the control body through the air intake orifice(s) 312 may mix with the aerosol precursor composition in the aerosolization zone 452 to form the aerosol, vapor and/or the like, and then may egress the aerosol delivery device 10 via the open first end 214 of the mouthpiece channel 216, and through the mouthpiece opening 207 defined in the mouth end 202 of the outer housing.

Turning now to the control body 300, the control body 300 may include a control component (not shown) (e.g., a microprocessor, individually or as part of a microcontroller) as described in some example implementations in U.S. Pat. App. Pub. No. 2015/0245658 to Worm et al., which is incorporated herein by reference in its entirety. The control component may be configured to operably engage the power source to receive power for control various operations of the aerosol delivery device 10. According to some aspects, the control component may be configured to receive electrical signals from additional and/or alternative control components (e.g., a separate control component, etc.). Additionally, a control component terminal may be configured to provide for electrical communication (i.e., electrical current, data signals, and/or the like) between two control components. Additionally or alternatively, a single control component (not shown) may be configured to control various operations of the aerosol delivery device 10, as previously described herein. For example, a housing arranged within the control body 300 may be configured to store a control component and/or a control component terminal therein, as described in U.S. Pat. App. Pub. No. 2015/0335071 to Brinkley et. al, which is incorporated herein by reference in its entirety.

Some aspects of control operations performed by the control component may include, for example, determining whether the cartridge 200 is genuine and/or perform other functions in conjunction therewith, such as indicate low battery, device status, and the like. Further, various examples of control components and functions performed thereby are described in U.S. Pat. App. Pub. No. 2014/0096781 to Sears et al., which is incorporated herein by reference in its entirety.

Yet other features, controls or components that can be incorporated into the aerosol delivery device 10 of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. No. 9,220,302 to DePiano et al.; U.S. Pat. App. Pub. Nos. 2010/0163063 by Fernando et al.; 2013/0192623 to Tucker et al.; 2013/0298905 to Leven et al.; 2013/0180553 to Kim et al. and 2014/0000638 to Sebastian et al.; 2014/0261495 to Novak et al.; which are incorporated herein by reference. For example, a printed circuit board (PCB) that includes a microprocessor and/or microcontroller, etc.), (e.g., a battery, which may be rechargeable, and/or a rechargeable supercapacitor), a manually actuatable button, the indicator 310 (e.g., a light emitting diode (LED)), any combination thereof, and the like.

In some implementations, input elements may be included (which may replace or supplement a cartridge sensor, and/or a manually actuated button configured to activate the atomizer). Any component or combination of components may be utilized as an input for controlling the function of the device 10. For example, one or more pushbuttons may be used as described in U.S. Pub. No. 2015/0245658 to Worm et al., which is incorporated herein by reference in its entirety. Likewise, a touchscreen may be used as described in U.S. Pat. App. Pub. No. 2016/0262454, to Sears et al., which is incorporated herein by reference in its entirety. As a further example, components adapted for gesture recognition based on specified movements of the aerosol delivery device 10 may be used as an input. See U.S. Pat. App. Pub. No. 2016/0158782 to Henry et al., which is incorporated herein by reference in its entirety. As still a further example, a capacitive sensor may be implemented on the aerosol delivery device 10 to enable a consumer to provide input, such as by touching a surface of the device on which the capacitive sensor is implemented.

Still further components can be utilized in the aerosol delivery device 10 of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth end of a device to detect consumer lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and PCT Pat. App. Pub. No. WO 2010/003480 by Flick discloses a fluid flow sensing system indicative of a puff in an aerosol generating system; all of the foregoing disclosures being incorporated herein by reference in their entireties.

Mechanisms for controlling the power output from the power source are also contemplated. For example, current actuation/deactuation mechanisms may include a temperature actuated on/off switch or a lip pressure actuated switch, or a touch sensor (e.g., capacitive touch sensor) configured to sense contact between a consumer (e.g., mouth or fingers of a consumer) and one or more surfaces of the aerosol delivery device 10. An example mechanism that can provide such puff-actuation capability includes a Model 163PC01D36 silicon sensor, manufactured by the Micro-Switch division of Honeywell, Inc., Freeport, Ill. With such sensor, the atomizer 420 may be activated rapidly by a change in pressure when the consumer draws on the device. In addition, flow sensing devices, such as those using hot-wire anemometry principles, may be used to cause the energizing of the atomizer 420 sufficiently rapidly after sensing a change in airflow. A further puff actuated switch that may be used is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure. Yet another suitable puff actuated mechanism is a vane which is deflected by airflow, the motion of which vane is detected by a movement sensing means. Yet another suitable actuation mechanism is a piezoelectric switch. Also useful is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that may be employed in a circuit according to the present disclosure are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. In some implementations, a pressure-sensing tube or other passage providing fluid connection between the puff actuated switch and the reservoir chamber 210 may be included in the cartridge 200 and/or control body 300 so that pressure changes during draw are readily identified by the switch. Other example puff actuation devices that may be useful according to the present disclosure are disclosed in U.S. Pat. Nos. 4,922,901, 4,947,874, and 4,947,874, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., and U.S. Pat. No. 8,205,622 to Pan, all of which are incorporated herein by reference in their entireties.

Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; U.S. Pat. No. 9,220,302 to DePiano et al.; U.S. Pat. App. Pub. Nos. 2006/0196518 and 2009/0188490 to Hon; U.S. Pat. App. Pub. No. 2010/0024834 to Oglesby et al.; U.S. Pat. App. Pub. No. 2010/0307518 to Wang; PCT Pat. App. Pub. No. WO 2010/091593 to Hon; and PCT Pat. App. Pub. No. WO 2013/089551 to Foo, each of which is incorporated herein by reference in its entirety.

Figure 10:
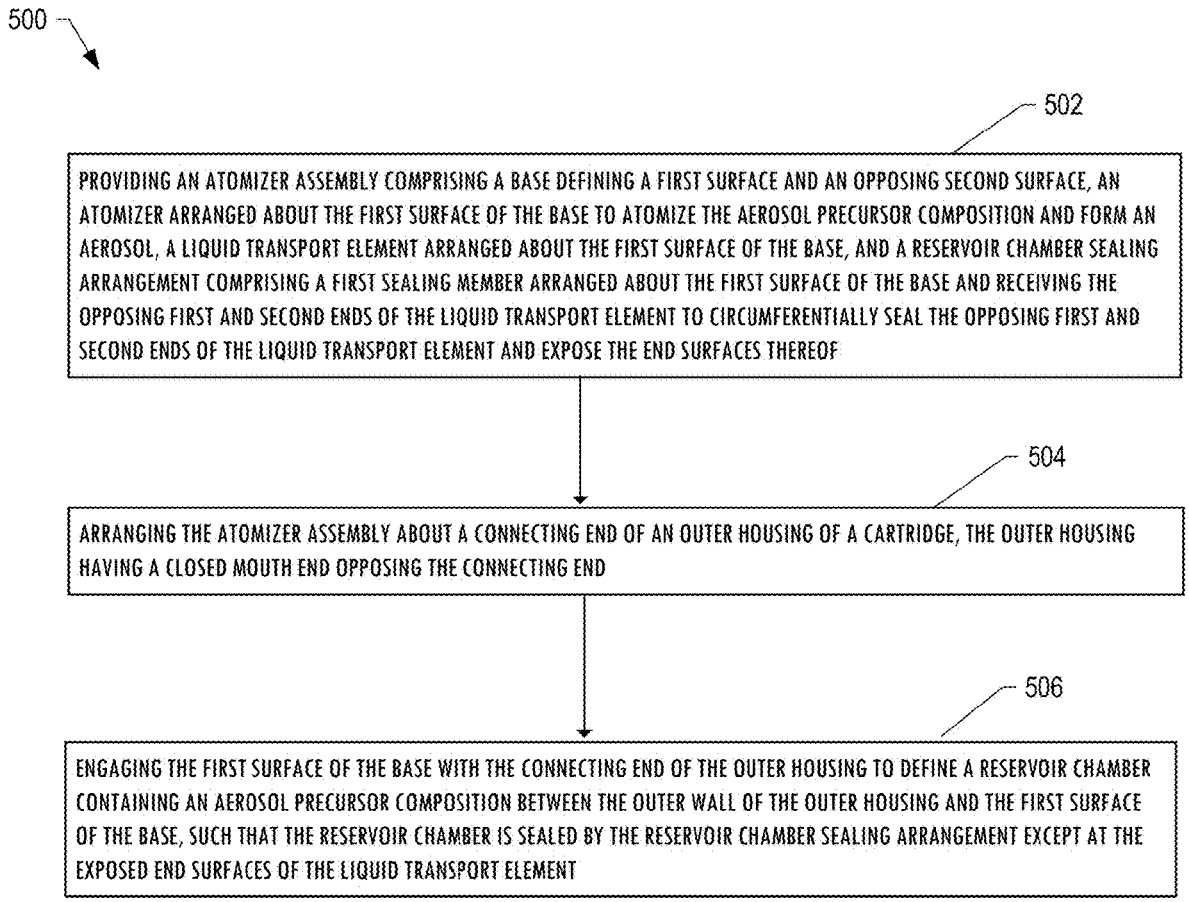
FIG. 10 illustrates a method flow diagram for a method of manufacturing a cartridge for an aerosol delivery device with improved sealing arrangement according to some example implementations of the present disclosure.

Referring to FIG. 10, aspects of the present disclosure may provide for a method, generally designated 500, of manufacturing a cartridge for an aerosol delivery device, such as that described hereinabove. The method 500 may comprise a first step, 502, of providing an atomizer assembly comprising a base defining a first surface and an opposing second surface, an atomizer arranged about the first surface of the base to atomize the aerosol precursor composition and form an aerosol, a liquid transport element arranged about the first surface of the base, and a reservoir chamber sealing arrangement comprising a first sealing member arranged about the first surface of the base and receiving the opposing first and second ends of the liquid transport element to circumferentially seal the opposing first and second ends of the liquid transport element and expose the end surfaces thereof. The method 500 may comprise a second step, 504, of arranging the atomizer assembly about a connecting end of an outer housing of a cartridge, the outer housing having a closed mouth end opposing the connecting end. The method 500 may comprise a third step, 506, of engaging the first surface of the base with the connecting end of the outer housing to define a reservoir chamber containing an aerosol precursor composition between the outer wall of the outer housing and the first surface of the base, such that the reservoir chamber is sealed by the reservoir chamber sealing arrangement except at the exposed end surfaces of the liquid transport element, wherein the exposed end surfaces of the liquid transport element are in fluid communication with the reservoir chamber so as to direct the aerosol precursor composition from the reservoir chamber through the end surfaces of the liquid transport element and into contact with the atomizer.

In some example implementations, the first step 502 of providing the atomizer assembly may comprise providing a flow director defining a base portion with a flow tube extending therefrom and arranged such that the first sealing member is disposed between the flow director and the first surface of the base, the flow tube being in fluid communication with the atomizer so as to direct the formed aerosol towards the mouth end of the outer housing.

In various implementations, the present disclosure may also be directed to kits that provide a variety of components as described herein. For example, a kit may comprise a control body and one or more cartridges and/or atomizer assemblies. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a receiving chamber of the control body, or, in other implementations, inserted in a separate aperture that enables a user to remove debris from the receiving chamber.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a cartridge comprising an outer housing formed of an outer wall, the outer housing having a mouth end and an opposing connecting end;

an atomizer assembly arranged about the connecting end of the outer housing and comprising:

a base defining a first surface and an opposing second surface, the first surface being engageable with the connecting end of the outer housing to define a reservoir chamber containing an aerosol precursor composition between the outer wall of the outer housing and the first surface of the base, an atomizer arranged about the first surface of the base to atomize the aerosol precursor composition and form an aerosol, a liquid transport element arranged about the first surface of the base and defining opposing first and second ends with exposed end surfaces that are in fluid communication with the reservoir chamber so as to direct the aerosol precursor composition from the reservoir chamber through the end surfaces of the liquid transport element and into contact with the atomizer, and a reservoir chamber sealing arrangement comprising a first sealing member arranged about the first surface of the base and receiving the opposing first and second ends of the liquid transport element to circumferentially seal the opposing first and second ends of the liquid transport element and expose the end surfaces thereof, such that the reservoir chamber is sealed by the reservoir chamber sealing arrangement except at the exposed end surfaces of the liquid transport element; and a control body operably engaged with the cartridge about the connecting end of the outer housing.

2. The aerosol delivery device of claim 1, wherein the reservoir chamber sealing arrangement comprises a flow director defining a base portion with a flow tube extending therefrom and arranged such that the first sealing member is disposed between the flow director and the first surface of the base, the flow tube being in fluid communication with the atomizer so as to direct the formed aerosol towards the mouth end of the outer housing.

3. The aerosol delivery device of claim 2, wherein the base further comprises a retaining member extending from the first surface thereof and engaging the flow director, the retaining member being arranged to compress the flow director against the first sealing member and the first surface of the base, and thereby seal the reservoir chamber except at the exposed end surfaces of the liquid transport element.

4. The aerosol delivery device of claim 3, wherein the retaining member comprises one or more pairs of arms extending substantially perpendicularly from the first surface of the base and one or more pairs of respective protrusions extending toward a center of the base, the protrusions engaging the base portion of the flow director to compress the base portion of the flow director against the first sealing member and the first surface of the base, and thereby seal the reservoir chamber except at the exposed end surfaces of the liquid transport element.

5. The aerosol delivery device of claim 4, wherein the first sealing member comprises a pair of opposing annular members comprising open receptacles, with a pair of opposite connecting flanges extending between the open receptacles, one of the first and second ends of the liquid transport element being at least partially received in one of the open receptacles such that the opposing first and second ends of the liquid transport element are circumferentially sealed by the open receptacles and the end surfaces are exposed, and the reservoir chamber is sealed by the reservoir chamber sealing arrangement at an interface between the base portion of the flow director and the flanges and receptacles of the liquid transport element except at the exposed end surfaces of the liquid transport element.

6. The aerosol delivery device of claim 3, wherein the cartridge further comprises a mouthpiece channel extending at least partially along a length of the reservoir chamber, the mouthpiece channel defining an open first and an open terminal end, the open first end being in fluid communication with the mouth end of the outer housing and the open terminal end being in fluid communication with the flow tube of the flow director such that the aerosol is directed through the mouthpiece channel.

7. The aerosol delivery device of claim 6, wherein the reservoir chamber sealing arrangement comprises a second sealing member arranged at the open terminal end of the mouthpiece channel to provide a seal between the flow tube and the mouthpiece channel.

8. The aerosol delivery device of claim 1, further comprising electrical contacts proximate the second surface of the base and providing electrical communication between the atomizer and a power source in the control body when the cartridge is engaged with the control body.

9. The aerosol delivery device of claim 8, wherein electrical terminals in electrical communication with the atomizer extend from the first surface of the base through the second surface of the base and contact the electrical contacts.

10. The aerosol delivery device of claim 1, wherein the atomizer comprises a coil having a plurality of turns and the liquid transport element defines an outer surface longitudinally extending between the end surfaces, the plurality of turns of the coil being wound about the outer surface and between the end surfaces of the liquid transport element.

11. A cartridge for an aerosol delivery device, the cartridge comprising:

an outer housing formed of an outer wall, the outer housing having a mouth end and an opposing connecting end; and an atomizer assembly arranged about the connecting end of the outer housing and comprising:

a base defining a first surface and an opposing second surface, the first surface being engageable with the connecting end of the outer housing to define a reservoir chamber containing an aerosol precursor composition between the outer wall of the outer housing and the first surface of the base, an atomizer arranged about the first surface of the base to atomize the aerosol precursor composition and form an aerosol, a liquid transport element arranged about the first surface of the base and defining opposing first and second ends with exposed end surfaces that are in fluid communication with the reservoir chamber so as to direct the aerosol precursor composition from the reservoir chamber through the end surfaces of the liquid transport element and into contact with the atomizer, and a reservoir chamber sealing arrangement comprising a first sealing member arranged about the first surface of the base and receiving the opposing first and second ends of the liquid transport element to circumferentially seal the opposing first and second ends of the liquid transport element and expose the end surfaces thereof, such that the reservoir chamber is sealed by the reservoir chamber sealing arrangement except at the exposed end surfaces of the liquid transport element.

12. The cartridge of claim 11, wherein the reservoir chamber sealing arrangement comprises a flow director defining a base portion with a flow tube extending therefrom and arranged such that the first sealing member is disposed between the flow director and the first surface of the base, the flow tube being in fluid communication with the atomizer so as to direct the formed aerosol towards the mouth end of the outer housing.

13. The cartridge of claim 12, wherein the base further comprises a retaining member extending from the first surface thereof and engaging the flow director, the retaining member being arranged to compress the flow director against the first sealing member and the first surface of the base, and thereby seal the reservoir chamber except at the exposed end surfaces of the liquid transport element.

14. The cartridge of claim 13, wherein the retaining member comprises one or more pairs of arms extending substantially perpendicularly from the first surface of the base and one or more pairs of respective protrusions extending toward a center of the base, the protrusion engaging the base portion of the flow director to compress the base portion of the flow director against the first sealing member and the first surface of the base, and thereby seal the reservoir chamber except at the exposed end surfaces of the liquid transport element.

15. The cartridge of claim 14, wherein the first sealing member comprises a pair of opposing annular members comprising open receptacles, with a pair of opposite connecting flanges extending between the open receptacles, one of the first and second ends of the liquid transport element being at least partially received in one of the open receptacles such that the opposing first and second ends of the liquid transport element are circumferentially sealed by the open receptacles and the end surfaces are exposed, and the reservoir chamber is sealed by the reservoir chamber sealing arrangement at an interface between the base portion of the flow director and the flanges and receptacles of the liquid transport element except at the exposed end surfaces of the liquid transport element.

16. The cartridge of claim 13, wherein the cartridge further comprises a mouthpiece channel extending at least partially along a length of the reservoir chamber, the mouthpiece channel defining an open first and an open terminal end, the open first end being in fluid communication with the mouth end of the outer housing and the open terminal end being in fluid communication with the flow tube of the flow director such that the aerosol is directed through the mouthpiece channel.

17. The cartridge of claim 16, wherein the reservoir chamber sealing arrangement comprises a second sealing member arranged at the open terminal end of the mouthpiece channel to provide a seal between the flow tube and the mouthpiece channel.

18. The cartridge of claim 11, wherein the atomizer comprises a coil having a plurality of turns and the liquid transport element defines an outer surface longitudinally extending between the end surfaces, the plurality of turns of the coil being wound about the outer surface and between the end surfaces of the liquid transport element.

19. A method of manufacturing a cartridge for an aerosol delivery device, the method comprising:

providing an atomizer assembly comprising a base defining a first surface and an opposing second surface, an atomizer arranged about the first surface of the base to atomize the aerosol precursor composition and form an aerosol, a liquid transport element arranged about the first surface of the base, and a reservoir chamber sealing arrangement comprising a first sealing member arranged about the first surface of the base and receiving the opposing first and second ends of the liquid transport element to circumferentially seal the opposing first and second ends of the liquid transport element and expose the end surfaces thereof, arranging the atomizer assembly about a connecting end of an outer housing of a cartridge, the outer housing having a closed mouth end opposing the connecting end; and engaging the first surface of the base with the connecting end of the outer housing to define a reservoir chamber containing an aerosol precursor composition between the outer wall of the outer housing and the first surface of the base, such that the reservoir chamber is sealed by the reservoir chamber sealing arrangement except at the exposed end surfaces of the liquid transport element, wherein the exposed end surfaces of the liquid transport element are in fluid communication with the reservoir chamber so as to direct the aerosol precursor composition from the reservoir chamber through the end surfaces of the liquid transport element and into contact with the atomizer.

20. The method of claim 19, wherein providing the atomizer assembly comprises providing a flow director defining a base portion with a flow tube extending therefrom and arranged such that the first sealing member is disposed between the flow director and the first surface of the base, the flow tube being in fluid communication with the atomizer so as to direct the formed aerosol towards the mouth end of the outer housing.

* * * * *